US005252439A

United States Patent [19]

Nakamura

[11] Patent Number: 5,252,439

[45] Date of Patent: Oct. 12, 1993

[54] METHOD OF REPLENISHING DEVELOPING SOLUTION WITH REPLENISHER

[75] Inventor: Koichi Nakamura, Kanagawa, Japan

[73] Assignee: Fuji Photo Film Co., Ltd., Kanagawa, Japan

[21] Appl. No.: 893,003

[22] Filed: Jun. 3, 1992

[30] Foreign Application Priority Data

Jun. 5, 1991 [JP] Japan ..... 3-159903

[51] Int. Cl.[5] ..... G03C 5/30; G03C 5/305; G03C 5/31; G03D 3/06

[52] U.S. Cl. ..... 430/399; 430/466; 430/484; 430/490; 430/492; 430/567; 354/303

[58] Field of Search ..... 430/567, 399, 442, 433, 430/466, 468, 484, 490, 492; 354/303

[56] References Cited

U.S. PATENT DOCUMENTS

| | | | |
|---|---|---|---|
| 4,501,812 | 2/1985 | Marchesano | 430/466 |
| 4,613,562 | 9/1986 | Kuse et al. | 430/399 |
| 4,923,787 | 5/1990 | Harder | 430/490 |
| 5,006,546 | 4/1991 | Morigaki et al. | 430/490 |
| 5,066,571 | 11/1991 | Yoshida et al. | 430/484 |
| 5,100,765 | 3/1992 | Fujimoto | 430/490 |

FOREIGN PATENT DOCUMENTS

| | | |
|---|---|---|
| 61-264343 | 11/1986 | Japan . |
| 63-81343 | 4/1988 | Japan . |
| 63-91657 | 4/1988 | Japan . |

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A method for processing an imagewise exposed color photographic material comprising a support having thereon at least one light-sensitive silver halide emulsion layer comprising a silver halide emulsion containing at least 90 mol % silver chloride, comprising the steps of: (a) developing in a color developing bath; (b) bleaching in a bath having a bleaching ability and fixing in a bath having a fixing ability or bleach-fixing in a bath having a bleaching and fixing ability; and (c) independently supplying a low pH replenisher and a high pH replenisher to the developing bath each in an amount depending on the quantity of photographic material processed, the low pH replenisher having a pH of from 2 to 6 and mainly containing a color developing agent and the high pH replenisher containing one or more components of the developing bath, wherein the components of the each replenisher are sufficiently diluted upon addition to the developing bath to avoid formation of a precipitate by mixing with the components of the unlike replenisher. The developing function can be recovered by addition of small amounts of the replenishing solutions to the developing bath. Consequently, the amount of waste liquid is reduced, which in turn benefits the environment.

17 Claims, 2 Drawing Sheets

METHOD OF REPLENISHING DEVELOPING SOLUTION WITH REPLENISHER

FIELD OF THE INVENTION

The present invention relates to a method of replenishing a color developing solution with a developing replenisher in processing a silver halide color photographic material, and particularly to a method of replenishing a developing solution with a concentrated developing replenisher in a reduced amount.

BACKGROUND OF THE INVENTION

In recent years, higher efficiency and productivity have been in increasing demand for processing of color photographic materials. This tendency is particularly remarkable in the preparation of color prints, and a reduction in print processing time has been strongly desired to provide shorter finishing times.

A color print finishing stage generally comprises exposure and color development processing, and subsequent desilverization, washing and/or stabilization and drying.

The use of a highly sensitive photographic material results in a reduction in exposure time. On the other hand, in order to shorten the color development time, it is necessary to use, in combination, a photographic material capable of rapid development with a compatible processing solution or processing method.

Known techniques for solving such problems include processing a color photographic material containing an emulsion having a high silver chloride content (high silver chloride emulsion), in place of silver chlorobromide emulsions having a high silver bromide content and which have been widely used for photographic materials for color prints (color photographic paper). For example, PCT International Publication No. WO87/ 04534 discloses a method of rapidly processing color photographic paper comprising a high silver chloride emulsion with a color developing solution substantially free from sulfite ion and benzyl alcohol.

In addition to the above patent, JP-A-61-70552 (the term "JP-A" as used therein means an "unexamined published Japanese patent application") discloses a method for reducing the quantity of replenisher for a developing solution, in which the replenisher is added in an amount such that there is no overflow of the developing bath during development, using a high silver chloride content color photographic material. Furthermore, JP-A-63-106655 discloses a method of processing a high silver chloride content color photographic material with a color developing solution containing a hydroxylamine compound and chloride ion at a specific minimum concentration to provide stable processing.

Thus, by use of a high silver chloride content emulsion or by adapting the developing solution, the development time can be shortened from 3.5 minutes (for example, color processing CP-20, Fuji Photo Film Co., Ltd.) to 45 seconds (for example, color processing CP-40FAS, Fuji Photo Film Co., Ltd., total processing time: 4 minutes).

The development function can be renewed by replenishing a developing solution with a developing replenisher depending on the consumption or deterioration state of the developing solution. In general, the developing solution is replenished with a developing replenisher containing a developing agent, a preservative, a chelating agent, a salt, an alkaline component and the like all in the same one solution, depending on the quantity of photographic material to be processed.

However, the solubility of the developing agent in a high pH replenisher solution containing the preservative or the alkaline component is less than the solubility in a low pH solution such as a neutral or acidic solution. As a result, it is difficult to prepare a highly concentrated replenisher solution. For this reason, when the developing solution must be replenished with a large amount of the developing agent, the replenishment rate must be increased. Accordingly, an increased amount of waste liquid overflows from the developing tank.

In recent years, it has been desired to reduce or prevent the generation of waste liquid in photographic processing, due to the complexity of treatment needed to make the photographic processing waste liquid environmentally sound. Also, when the developing solution is replenished, the concentration of the developing agent in the developing replenisher is conceivably raised to reduce the replenishment rate such that the developing solution does not overflow. However, it is difficult to increase the amount of the developing agent dissolved in solution as long as the developing replenisher contains high pH components such as the alkaline component.

Recently, the rapid processing of color photographic paper which does not generate polluting waste liquid has been desired. Accordingly, investigators have sought to reduce the replenishment rate of color developing solutions as applied to rapid processing of color photographic paper using silver halide emulsions containing 90 mol % or more of silver chloride, to thereby reduce the waste liquid amount of the color developing solution containing a large quantity of harmful substances. For this purpose, it has been proposed to separately replenish the developing solution with a low pH replenisher mainly containing a color developing agent and a high pH replenisher containing components other than the color developing agent, such that the concentration of the color developing agents can be increased in the low pH replenisher. The replenishment rate can therefore be reduced, which results in the discharge of little or no waste liquid.

The developing solution is replenished with such a replenisher, depending on the quantity of photographic material to be processed, the pH of the developing solution, the change in solution amount due to evaporation, and the change in composition due to air oxidation. When the developing solution is replenished by concurrently admixing the low pH replenisher or concentrated developing solution and the high pH replenisher containing components other than the developing agent, a precipitate results which not only lowers the replenishment function, but also introduces the problem of treating the precipitate.

Furthermore, it has been found that the developing agent in the low pH replenisher gradually deteriorates during long storage and adversely affects photographic images.

SUMMARY OF THE INVENTION

It is therefore an object of the present invention to solve the above-described problems, and to provide a method for replenishing a developing solution with a small amount of a developing replenisher without the formation of a precipitate, which developing solution is well adapted to rapid processing of color photographic paper.

Another object of the invention is to provide a method for replenishing a developing solution with a developing replenisher which has a low pH sufficient to make it possible to prepare a concentrated solution of a developing agent and which has an excellent long storability and does not cause any decrease in photographic sensitivity and any increase in the minimum density of a photographic image.

The above objects of the present invention are attained by providing a method for processing an imagewise exposed color photographic material comprising a support having thereon at least one light-sensitive silver halide emulsion layer comprising a silver halide emulsion containing at least 90 mol % silver chloride, comprising the steps of: (a) developing in a color developing bath; (b) bleaching in a bath having a bleaching ability and fixing in a bath having a fixing ability or bleach-fixing in a bath having a bleaching and fixing ability; and (c) independently supplying a low pH replenisher and a high pH replenisher to the developing bath each in an amount depending on the quantity of photographic material processed, said low pH replenisher having a pH of from 2 to 6 and mainly containing a color developing agent and said high pH replenisher containing one or more components of the developing bath, wherein the components of each replenisher are sufficiently diluted upon addition to the developing bath to avoid formation of a precipitate by mixing with the components of the unlike replenisher.

DETAILED DESCRIPTION OF THE INVENTION

Figure 1:
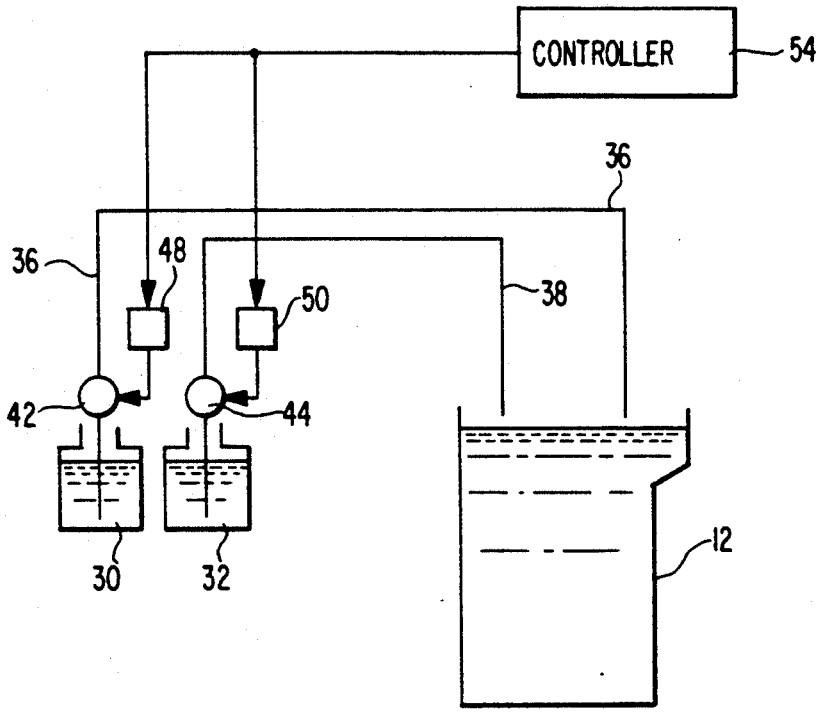
FIG. 1 is a schematic view showing a device for replenishing a developing bath for use in the present invention.

When the developing solution is replenished by independently supplying thereto a low pH replenisher and a high pH replenisher in accordance with the present invention, the components of each replenisher are sufficiently diluted upon addition to the developing bath to avoid the formation of a precipitate by mixing with the components of the other unlike replenisher. When simultaneously added to the developing bath, the points for addition of each of the unlike replenishers are positioned sufficiently apart from one another as to not form a precipitate. For example, separate pipes may be used to simultaneously supply each of the low pH replenisher and the high pH replenisher to the developing bath, where the points for addition of the replenishers to the developing bath are sufficiently positioned apart from another as to not form a precipitate. Also in accordance with the present invention, the low pH replenisher and high pH replenisher may each be supplied to the developing bath at different (staggered) time intervals through the same pipe or through separate pipes. An appropriate combination of staggered time intervals for addition and positioning of the supply pipes may also be employed. Methods of adding each of the replenishers at a distance include adding the replenishers to the developing bath through nozzles located apart from one another, and adding one replenisher below the liquid surface level of the developing bath and the other replenisher at the liquid surface of the developing bath.

In view of precipitation on the inner surface of the supply pipes (particularly in the case of a long operation period) it is most preferred to add the low pH replenisher and the higher pH replenisher to the developing bath through separate pipes.

Also in accordance with a preferred embodiment of the invention, one replenisher is diluted at least two fold in concentration in the developing bath before adding the other unlike replenisher.

Furthermore, the low pH replenisher for use in the present invention preferably contains a sulfinic acid or a salt thereof and has a pH of from 2 to 6. This is effective in stabilizing the low pH replenisher containing the developing agent in a high concentration during long storage.

The low pH replenisher for use in the present invention preferably contains 0.05 mol/l or more of a color developing agent.

It is also preferred that the low pH replenisher and the high pH replenisher are rapidly mixed in the developing bath and that in order to make the replenishment device simple and small both replenishers are supplied to the developing bath alternately (if necessary at different time intervals) at the same level of the developing bath.

The solution circulation rate in the developing solution may be 1 l/min, and preferably from 4 to 24 l/min, in order to instantaneously mix each replenisher in the tank solution.

The tank capacity is preferably small and is preferably up to 20 l, particularly preferably up to 5 l.

The inside diameter of the replenisher supply pipe may be from 1 to 10 mm, and preferably from 2 to 5 mm.

For preventing the formation of precipitates due to the mixing of each concentrated replenisher it is preferred that the replenisher supply pipes are located apart from one another by five times or more, and preferably 10 times or more the inside diameter of the pipe.

When the pipes are placed in a vertical direction it is preferred that at least one pipe is positioned at a vertical distance of one third of the depth of the developing solution below the surface level.

When the replenishers are each supplied to the developing bath at different (staggered) time intervals, the a staggered time intervals are preferably from 1/60 to 1/1200 of the value of tank capacity (liter)/solution circulation rate (l/min) because the mixing of the initially supplied replenisher in the tank solution largely depends on the tank capacity and the solution circulation rate.

In the present invention, the developing replenisher comprises at least a low pH replenisher mainly containing a color developing agent and a high pH replenisher containing one or more components of the developing solution preferably other than the developing agent. Furthermore, a large amount of the developing agent can be dissolved in the low pH replenisher. Accordingly, the low pH replenisher for replenishing the developing agent has a high developing agent concentration, and the development function can be recovered by supplying a small amount of the replenisher to the developing bath. Furthermore, the developing solution is also replenished with the high pH replenisher containing replenishing components, based on the pH of the developing solution, such that the pH of the developing solution is maintained sufficiently high by replenishing a small amount of the replenisher.

According to the present invention the developing replenisher is divided into two replenishers having different pH values and the two replenishers are added separately so that they are not mixed before being supplied. A method comprising supplying only a high pH solution in use has been widely used for supplying a replenisher.

The pH of the replenisher has not been lowered previously, because such a step is considered to have the disadvantage of making the process complicated.

On the other hand, although the solubility of the developing agent in solution is remarkably increased at a pH of 6 or less, it has been found that in an open system the developing agent gradually deteriorates with time and that particularly it is not preferred to store the developing agent in solution for long.

When the replenishment processing is carried out by using a long-stored replenisher, the increase in the minimum density (Dmin) of a photographic image and the decrease in sensitivity have occurred in correspondence to the deterioration degree of the developing agent.

In the present invention, therefore, it has become necessary to prevent the deterioration of and improve the stability of the developing agent in the replenisher at a pH of 6 or less.

Also on this point the present inventors have made extensive studies to find that the use in the low pH replenisher of a compound capable of scavenging the oxidation product of the developing agent in the range of the pH claimed in the present invention, makes it possible to prevent the deterioration of the developing agent and to inhibit the occurrence of tar-like products formed as a result of the deterioration of the developing agent. Sulfites are well known compounds that react with the oxidation products of hydroquinones and p-phenylenediamine derivatives. However, when the high-silver chloride content, color photographic material is processed by color development in the present invention, the use of a sulfite is not desirable because the solubility of the silver salt in a high content and the coloring efficiency are lowered.

The present inventors have found that when a sulfinic acid or a salt thereof which is described as compounds capable of reacting with the oxidation product of the developing agent in *The Chemistry of Quinoid Compounds*, Vol. II, Chap. 21 is incorporated into the low pH replenisher, the deterioration of the developing agent in an open system is greatly inhibited. Also, unlike sulfites, a sulfinic acid and a salt thereof are desirable because they have no adverse effects on the developability in color development and do not reduce coloring efficiency.

The present invention has made it possible to store the replenisher in a high concentration and in a stable condition for a long time, to handle the replenisher in an open system and to replenish the developing solution with the low pH and high pH replenishers used separately without simultaneously by mixing the two replenishers.

JP-A-1-230039 describes that particularly, a sulfinic acid or a salt thereof improves the stability of the bleach-fixing solution, fixing solution, a washing process and a stabilization process and is used in the processing steps for photographic materials in order to prevent the occurrence of stains. However, JP-A-1-230039 does not suggest the prevention of the deterioration of the developing agent in such a low pH replenisher as used in the present invention. Also, JP-A-1-230039 does not suggest that a small amount of the long-stored replenisher can prevent the decrease in photographic sensitivity and inhibit the increase in Dmin.

Examples of the components which may be contained in the high pH replenisher for use in the present invention include a buffer, an alkaline agent, (a chelating agent), (an antifogging agent), a fluorescent brightening agent, (a surface active agent), (a development accelerator), a small amount of a color developing agent, (a preservative) and a water-soluble polymer, wherein the color developing agent is contained at a concentration of 1/10 or less, and preferably at a concentration of 1/100 or less the concentration of the developing agent in the low pH replenisher. Components which may be contained in the low pH replenisher include (a chelating agent), (an antifogging agent), (a surface active agent), (a development accelerator), (a preservative), and (a water-soluble polymer) as well as a color developing agent. For lowering the pH of the low pH replenisher, the color developing agent is preferably used in the form of an acid salt such as a sulfate.

The above-described components designated in parentheses may be separately added to the indicated replenisher only, or may be added to any of the low or high pH replenishers without adverse effect.

Specific compounds thereof are described below.

The pH of the low pH replenisher containing the developing agent is preferably 2 to 6, and more preferably 3 to 5. The amount of the color developing agent contained in the low pH replenisher is 0.05 mol/l or more, and preferably in the range from 0.1 mol/l to 0.6 mol/l.

The pH of the high pH replenisher containing replenishing components for the color developing solution other than the developing agent is 9 or more, preferably 10 or more, and more preferably in the range from 12 to 14.

The color photographic material (color photographic paper) for use in the present invention can comprise a support having thereon at least one each of a blue-sensitive, green-sensitive and red-sensitive silver halide emulsion layer. For ordinary color photographic paper, the red-sensitive silver halide emulsion layer is usually arranged closest to the support; however, the arrangement order may be modified depending on the intended application.

Known image forming systems for rapid processing of color photographic paper are generally applicable to the present invention, and can also be used for intelligent color hard copying which requires even faster processing.

In particular, a preferred embodiment of intelligent color hard copying comprises scanning exposure using a high density light such as light emitted by a laser (for example, a semiconductor laser) or a light emitting diode.

The semiconductor laser light emits radiation in the infrared region in many cases, and therefore an infrared-sensitive silver halide emulsion layer can be used in place of one of the above-described emulsion layers sensitive to visible light in the photographic material for use in the present invention. As used herein, "light-sensitive" includes sensitivity to both visible and infrared light. Each of the sensitive emulsion layers generally contains a silver halide emulsion having sensitivity to a particular wavelength region and a dye complementary to light to which the emulsion layer is sensitive. Namely, a color coupler forming a yellow image is used in a blue-sensitive silver halide emulsion layer, a magenta forming coupler is used in a green-sensitive layer, while a cyan forming coupler is used in a red-sensitive layer, to allow for a subtractive color process. However, the sensitive emulsion layers and color couplers may be combined to correspond in a manner different from that described above.

Furthermore, depending on the desired image quality and other considerations, the color coupler may form two colors. In this case, two silver halide emulsion layers may be used corresponding to the respective colors. Although full color images are not formed in this case, it is possible to form images more rapidly.

The silver halide emulsion for use in the present invention comprises silver chlorobromide containing at least 90 mol % silver chloride or comprises silver chloride. Grains constituting the emulsion may be the same or different from one another in terms of halogen composition. However, when the grains constituting the emulsion each have the same halogen composition, uniform properties of each grain is readily achieved. With respect to the internal halogen composition distribution of the silver halide grains, a uniform type structure in which the composition is the same at any portion of the grain, a laminated type structure in which the halogen composition of the internal core of the grain is different from that of the surrounding shell (one layer or a plurality of layers), or a structure in which the inside of the grain or the surface thereof has non-layer portions differing in halogen composition (e.g., a structure in which the portions different in halogen composition are connected to the edges, the corners or the surface of the grain when on the surface of the grain) may be used. In order to obtain high sensitivity, it is more advantageous to use either of the latter two grains types as opposed to grains having a uniform structure. The latter two non-uniform grains are also preferable with respect to pressure resistance. When the silver halide grains have a structure as described above, the boundary between portions having a different halogen composition may be distinct, or may be obscured by the formation of mixed crystals resulting from the difference in composition. Further, a continuous change in structure may also be imparted to the silver halide grains.

On the other hand, to minimize the reduction in sensitivity when pressure is applied to the photographic material, grains having a uniform structure in which the halogen composition distribution within the grain is small are preferably used in the high silver chloride emulsion of the present invention containing at least 90 mol % silver chloride.

Furthermore, for reducing the quantity of replenisher to a developing solution, it is also effective to increase the silver chloride content of the silver halide emulsion. In this case, an emulsion containing almost pure silver chloride such that the silver chloride content thereof is 98 to 100 mol % is preferably used.

The silver halide grains contained in the silver halide emulsion for use in the present invention preferably have a mean grain size of 0.1 to 2 μm. The mean grain size is a number mean value of grain sizes represented by the diameters of circles having areas equivalent to the projected areas of the grains.

Furthermore, the emulsion for use in the present invention is preferably a monodisperse emulsion having a narrow grain size distribution; namely, a coefficient of variation (the standard deviation of the grain size distribution divided by the mean grain size) of not more than 20%, desirably not more than 15%. For the purpose of obtaining a wide latitude, the above-described monodisperse emulsions can be blended in the same layer, or may be coated in the form of multiple layers.

The silver halide grains contained in the photographic emulsion may have a regular crystal form such as a cubic, an octahedral or a tetradecahedral form, an irregular crystal form such as a spherical form or a plate (tabular) form, or a composite form thereof. Furthermore, a mixture of grains having various crystal forms may also be used. In the present invention, the emulsion preferably contains at least 50%, preferably at least 70% and more preferably at least 90% of the above-described grains having a regular crystal form.

Aside from the above, a tabular emulsion can also be used, wherein more than 50% of all grains on a projected area basis are tabular grains having a mean aspect ratio (a ratio of diameter calculated as a circle/thickness) of at least 5 and preferably at least 8.

In order to improve image sharpness, the hydrophilic colloid layer of the photographic material of the present invention preferably contains a dye which is discolored upon processing (particularly an oxonol dye) as described at pages 27 to 76 of European Patent EP 0,337,490A2, to provide an optical reflection density of 0.70 or more at 680 nm. The water-resistant resin layer of the support of the photographic material of the present invention preferably also contains at least 12% by weight (more preferably, at least 14% by weight) titanium oxide surface treated with a divalent to tetravalent alcohol (for example, trimethylolethane).

In the photographic material of the present invention, compounds for improving the storage quality of color images as described in European Patent EP 0,277,589A2 are preferably used in combination with the couplers. In particular, they are preferably used in combination with pyrazoloazole couplers.

In order to prevent the generation of stains and other undesirable effects due to formation of an unwanted dye by reaction of residual color developing agent or an oxidation product thereof with a coupler during storage after processing, the compound (F) and or (a) are preferably incorporated into the photographic material. The compound (F) chemically bonds to aromatic amine developing agent remaining after color development to form a chemically inactive, substantially colorless compound. The compound (G) chemically bonds to an oxidation product of the aromatic amine color developing agent remaining after color development to form a chemically inactive, substantially colorless compound. The compounds (F) and (G) may be used alone or in combination. The compounds (F) and (G) are described in JP-A-62-283338, JP-A-62-229145 and JP-A-3-229246 and used in an amount, per mol of a coupler, of preferably from $1\times10^{-2}$ to 10 mol, more preferably from $3\times10^{-2}$ to 5 mol.

Furthermore, an antifungal agent as described in JP-A-63-271247 is preferably added to the photographic material of the present invention to prevent images deterioration by the proliferation of various molds and bacteria in the hydrophilic colloidal layers.

A white polyester support or a support provided with a white pigment-containing layer on the emulsion layer side thereof may be used in a photographic material for display of the present invention. Furthermore, in order to improve sharpness, an antihalation layer is preferably formed on the side coated with a silver halide emulsion layer or on the back surface of the support. In particular, the transmission density is preferably adjusted within the range of 0.35 to 0.8 such that the display can be appreciated with both reflected light and transmitted light.

The photographic material of the present invention may be exposed to visible light or infrared light. The exposure may comprise either low illuminance exposure or high illumination exposure for a short time period. In particular, in the latter case, a laser scanning exposure method in which the exposure time per picture element is shorter than $10^{-4}$ second is preferred.

For exposure, the band stop filter described in U.S. Pat. No. 4,880,726 is preferably used, such that optical color mixing is eliminated and color reproducibility is markedly improved.

The exposed photographic material is generally subjected to color development. Bleach-fixing is preferably conducted after color development for rapid processing. In particular, when the above-described high silver chloride emulsion is used, the pH of the bleach-fixing solution is preferably about 6.5 or less, and more preferably about 6 or less to enhance desilverization.

Preferred silver halide emulsions, additives and photographic constituent layer structure (such as layer arrangement) which may be applied to the photographic material of the present invention, and processing methods and additives for processing compositions for use in the present invention, are described in the following patents shown in Table A, particularly in European Patent EP 0,355,660A2 (Japanese Patent Application No. 1-107011).

TABLE A

| Photographic Constituents, etc. | JP-A-62-215272 | JP-A-2-33144 | EP 0,355,660A2 |
|---|---|---|---|
| Silver Halide Emulsions | Page 12, lower left column, lines 6 to 14; page 13, upper left column, line 3 from the bottom to page 18, lower left column, the last line | — | — |
| Chemical Sensitizers | Page 12, lower left column, line 3 from the bottom to lower right column, line 5 from the bottom; page 18, lower right column, line 1, to page 22, upper right column, line 9 from the bottom | Page 29, lower right column, line 12 to the last line | Page 47, lines 4 to 9 |
| Spectral Sensitizers (Spectrally Sensitizing Methods) | Page 22, upper right column, line 8 from the bottom to page 38, the last line | Page 30, upper left column, lines 1 to 13 | Page 47, lines 10 to 15 |
| Emulsion Stabilizers | Page 39, upper left column, line 1 to page 72, upper right column, the last line | Page 30, upper left column, line 14 to upper right column, line 1 | Page 47, lines 16 to 19 |
| Development Accelerators | Page 72, lower left column, line 1 to page 91, upper right column, line 3 | — | — |
| Color Couplers (Cyan, Magenta, Yellow Couplers) | Page 91, upper right column, line 4 to page 121, upper left column, line 6 | Page 3, upper right column, line 14 to page 18, upper left column, the last line; page 30, upper right column, line 6 to page 35, lower right column, line 11 | Page 4, lines 15 to 27; page 5, line 30 to page 28, the last line; page 45, lines 29 to 31; page 47, line 23 to page 63, line 50 |
| Color Development Increasing Agents | Page 121, upper left column, line 7 to page | — | — |

TABLE A-continued

| Photographic Constituents, etc. | JP-A-62-215272 | JP-A-2-33144 | EP 0,355,660A2 |
|---|---|---|---|
| | 125, upper right column, line 1 | | |
| Ultraviolet Absorbers | Page 125, upper right column, line 2 to page 127, lower left column, the last line | Page 37, lower right column, line 14 to page 38, upper left column, line 11 | Page 65, lines 22 to 31 |
| Antifading Agents (Image Stabilizers) | Page 127, lower right column, line 1 to page 137, lower left column, line 8 | Page 36, upper right column, line 12 to page 37, upper left column, line 19 | Page 4, line 30 to page 5, line 23; page 29, line 1 to page 45, line 25; page 45, lines 33 to 40; page 65, lines 2 to line 21 |
| High Boiling and/or Low Boiling Organic Solvents | Page 137, lower left column, line 9 to page 144, upper right column, the last line | Page 35, lower right column, line 14 to page 36, upper left column, line 4 from the bottom | Page 64, lines 1 to 51 |
| Methods for Dispersing Photographic Additives | Page 144, lower left column, line 1 to page 146, upper right column, line 7 | Page 27, lower right column, line 10 to page 28, upper left column, the last line; page 35, lower right column, line 12 to page 36, upper right column, line 7 | Page 63, line 51 to page 64, line 56 |
| Hardener | Page 146, upper right column, line 8 to page 155, lower left column, line 4 | — | — |
| Developing Agent Precursors | Page 155, lower left column, line 5 to lower right column, line 2 | — | — |
| Development Restrainer-Releasing Compounds | Page 155, lower right column, lines 3 to 9 | — | — |
| Supports | Page 155, lower right column, line 19 to page 156, upper left column, line 14 | Page 38, upper right column, line 18 to page 39, upper left column, line 3 | Page 66, line 29 to page 67, line 13 |
| Photographic Material Layer Constitution | Page 156, upper left column, line 15 to page 156, lower right column, line 14 | Page 28, upper right column, lines 1 to 15 | Page 45, lines 41 to 52 |
| Dyes | Page 156, lower right column, line 15 to page 184, lower right column, the last line | Page 38, upper left column, line 12 to upper right column, line 7 | Page 66, lines 18 to 22 |
| Color Mixing Inhibitors | Page 185, upper left column, line 1 to lower right column, line 3 | Page 36, upper right column, lines 8 to 11 | Page 64, line 57 to page 65, line 1 |
| Gradation Modifiers | Page 188, lower right column, lines 4 to 8 | — | — |
| Stain Inhibitors | Page 188, lower right column, line 9 to page | Page 37, upper right column, the last line | Page 65, line 32 to page 66, line 17 |

TABLE A-continued

| Photographic Constituents, etc. | JP-A-62-215272 | JP-A-2-33144 | EP 0,355,660A2 |
|---|---|---|---|
| | 193, lower right column, line 10 | to lower right column, line 13 | |
| Surfactants | Page 201, upper left column, line 1 to page 210, upper right column, the last line | Page 18, upper right column, line 1 to page 24, lower right column, the last line; page 27, lower left column, line 10 from the bottom to lower right column, line 9 | — |
| Fluorine-Containing Compounds (Antistatic Agents, Coating Aids, Lubricants, Adhesion Inhibitors) | Page 210, lower left column, line 1 to page 222, lower left column, line 5 | Page 25, upper left column, line 1 to page 27, lower right column, line 9 | — |
| Binders (Hydrophilic Colloids) | Page 222, lower left column, line 6 to page 225, upper left column, the last line | Page 38, upper right column, lines 8 to 18 | Page 66, lines 23 to 28 |
| Tackifiers | Page 225, upper right column, line 1 to page 227, upper right column, line 2 | — | — |
| Antistatic Agents | Page 227, upper right column, line 3 to page 230, upper left column, line 1 | — | — |
| Polymer Latices | Page 230, upper left column, line 2 to page 239, the last line | — | — |
| Matting Agents | Page 240, upper left column, line 1 to upper right column, the last line | — | — |
| Photographic Processing Methods (Processing Stages and Additives) | Page 3, upper right column, line 7 to page 10, upper right column, line 5 | Page 39, upper left column, line 4 to page 42, upper left column, the last line | Page 67, line 14 to page 69, line 28 |

Note: The cited portions of JP-A-62-215272 include the amendment dated Mar. 16, 1987 as appended thereto. In addition to the above-described color couplers, the short wave type yellow couplers described in JP-A-63-231451, JP-A- 63-123047, JP-A-63-241547, JP-A-1-173499, JP-A-1-213648 and JP-A-1-250944 are also preferably used in the photographic material of the present invention.

Preferred cyan couplers include 3-hydroxypyridine cyan couplers described in European Patent EP0,333,1-85A2 (2 equivalent couplers prepared by providing a chlorine elminable group to the 4 equivalent coupler of coupler (42), and couplers (6) and (9) which are enumerated therein and particularly preferred among others) and cyclic active methylene cyan couplers as described in JP-A-64-32260 (couplers 3, 8 and 34 enumerated therein are particularly preferred among others), as well as the diphenylimidazole cyan couplers described in JP-A-2-33144.

In the present invention, the color photographic material is preferably subjected to color development, bleach-fixing and washing (or stabilizing processing). Bleaching and fixing may be separately carried out in different baths unlike a single bath process as for a bleach-fixing process.

Typical examples of the color developing agent for use in the color developing solution of present invention include, but are not limited, to the following compounds:

D-1 N,N-diethyl-p-phenylenediamine

D-2 4-Amino-N,N-diethyl-3-methylaniline

D-3 4-Amino-N-(β-hydroxyethyl)-N-methylaniline

D-4 4-amino-N-ethyl-N-(β-hydroxyethyl)aniline
D-5 4-Amino-N-ethyl-N-(β-hydroxyethyl)-3-methylaniline
D-6 4-Amino-N-ethyl-N-(3-hydroxypropyl)-3-methylaniline
D-7 4-Amino-N-ethyl-N-(4-hydroxybutyl)-3-methylaniline
D-8 4-Amino-N-ethyl-N-(β-methanesulfonamidoethyl)-3-methylaniline
D-9 4-Amino-N,N-diethyl-3-(β-hydroxyethyl)aniline
D-10 4-Amino-N-ethyl-N-(β-methoxyethyl)-3-methylaniline
D-11 4-Amino-N-(β-ethoxyethyl)-N-ethyl-3-methylaniline
D-12 4-Amino-N-(3-carbamoylpropyl-N-n-propyl-3-methylaniline
D-13 4-Amino-N-(4-carbamoylbutyl-N-n-propyl-3-methylaniline
D-14 N-(4-amino-3-methylphenyl)-3-hydroxypyrrolidine
D-15 N-(4-amino-3-methylphenyl)-3-(hydroxymethyl)-pyrrolidine
D-16 N-(4-amino-3-methylphenyl)-3-pyrrolidinecarboxyamide Of the above-described p-phenylenediamine derivatives, compounds D-5, D-6, D-7, D-8 and D-12 are preferable, and compound D-8 is particularly preferable. The above noted developing agents are effective for use in the replenishing method of the present invention.

The p-phenylenediamine derivatives may be salts such as sulfates, hydrochlorides, sulfites, naphthalenedisulfonates and p-toluenesulfonates. The aromatic primary amine color developing agents is preferably contained in an amount of from 0.002 to 0.2 mol per liter of the developing solution (tank solution), and more preferably in an amount of from 0.005 to 0.1 mol per liter of the developing solution.

In the present invention, the developing solution is preferably substantially free from benzyl alcohol. As used herein, the developing solution substantially free from benzyl alcohol contains benzyl alcohol preferably at a concentration of not more than 2 ml/l, more preferably at a concentration of not more than 0.5 ml/l, and most preferably contains no benzyl alcohol at all.

The developing solution or replenishers thereof for use in the present invention preferably are substantially free from sulfite ion. Sulfite ion dissolves silver halides and reacts with the oxidation product of a developing agent to reduce dye forming efficiency, and also serves as a preservative for the developing agent. The action of sulfite ion is considered to cause increased fluctuation in photographic properties by continuous processing. As used herein, the developing solution substantially free from sulfite ion contains sulfite ion preferably at a concentration of not more than 0.10 mol per liter of the developing agent, and most preferably contains no sulfite ions at all, with the exception of a very small amount of sulfite ion used for prevention of oxidation of the concentrated developing agent in the processing agent kit prior to preparation of the developing solution.

The developing solution for use in the present invention preferably is substantially free from sulfite ion, and furthermore is preferably substantially free from unsubstituted hydroxylamine. This is because hydroxylamine itself has a silver developing activity, as well as a preservative function for the developing solution. Therefore, fluctuations in the concentration of hydroxylamine are considered to exert a significant influence on photographic properties. As used herein, the developing solution substantially free from hydroxylamine contains hydroxylamine preferably at a concentration of not more than $5.0\times10^{-3}$ mol/l, and most preferably contains no hydroxylamine at all.

The developing solution or the replenishers thereof for use in the present invention preferably contain an organic preservative in place of the above-described hydroxylamine or sulfite ion.

As used herein, an organic preservative is an organic compound which reduces the rate of degradation of the aromatic primary amine color developing agent by addition of the organic compound to the developing solution for processing the color photographic material. Namely, the organic preservative is an organic compound which protects the color developing agent from oxidation with air or the like. In particular, effective organic preservatives include substituted hydroxylamines (but not including unsubstituted hydroxylamine, which distinction also applies hereinafter), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds and condensed cyclic amines. The above noted organic preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-48-30496 (the term "JP-B" as used herein means an "examined Japanese patent publication").

The preservative is used in an amount of preferably from 0.01 to 1.5 mol/l, more preferably from 0.03 to 0.5 mol/l.

Other useful preservatives including various metals described in JP-A-57-44148 and JP-A-57-53749, salicylic acid derivatives described in JP-A-59-180588, alkanolamines described in JP-A-54-3532, polyethyleneimines described in JP-A-56-94349 and aromatic polyhydroxy compounds described in U.S. Pat. No. 3,746,544 may be incorporated into the developing solution as needed. In particular, alkanolamines such as triethanolamine, dialkylhydroxylamines such as diethylhydroxylamine, hydrazine derivatives or aromatic polyhydroxy compounds are preferred.

Of the above-described preservatives, substituted hydroxylamine and hydrazine derivatives (such as hydrazines and hydrazides) are particularly preferable. Details thereof are described in JP-A-1-97953, JP-A-1-186939, JP-A-186940 and JP-A-1-187557.

For improving the stability of the color developing solution, which in turn improves the stability upon continuous processing, the above-described substituted hydroxylamines or hydrazine derivatives are preferably used in combination with amines.

The above-described amines include cyclic amines described in JP-A-63-239447, amines described in JP-A-63-128340 and amines described in JP-A-1-186939 and JP-A-1-187557.

In the present invention, substituted hydroxylamines represented by the following formula (I) are preferably incorporated into the developing solution:

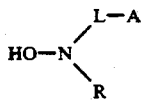

(I)

wherein L represents an alkylene group which may be substituted; A represents a carboxyl group, a sulfo group, a phosphono group, a phosphine group, a hydroxyl group, an amino group which may have an alkyl substituent group, an ammonio group which may have an alkyl substituent group, a carbamoyl group which may have an alkyl substituent group, a sulfamoyl group which may have an alkyl substituent group or an alkylsulfonyl group which may be substituted; and R represents a hydrogen atom or an alkyl group which may be substituted.

Formula (I) is described in greater detail below.

In formula (I), L represents a straight chain or branched chain alkylene group having 1 to 10 carbon atoms which may be substituted by a substituent group, preferably having 1 to 5 carbon atoms. Specifically, preferred examples of L include methylene, ethylene, trimethylene and propylene. The substituent group for L is a carboxyl group, a sulfo group, a phosphono group, a phosphinic acid residue, a hydroxyl group or an ammonio group which may have an alkyl substituent group. Preferred examples thereof include carboxyl, sulfo, phosphono and hydroxyl. A represents a carboxyl group, a sulfo group, a phosphono group, a phosphinic acid residue, a hydroxyl group, an amino group which may have an alkyl substituent group, an ammonio group which may have an alkyl substituent group, a carbamoyl group which may have an alkyl substituent group, a sulfamoyl group which may have an alkyl substituent group or an alkylsulfonyl group which may substituted. Preferred examples of A include carboxyl, sulfo, hydroxyl, phosphono and carbamoyl which may have an alkyl substituent group. Preferred examples of —L—A include carboxymethyl, carboxyethyl, carboxypropyl, sulfoethyl, sulfopropyl, sulfobutyl, phosphonomethyl, phosphonoethyl and hydroxyethyl. In particular, carboxymethyl, carboxyethyl, sulfoethyl, sulfopropyl, phosphonomethyl and phosphonoethyl are preferable among others. R represents a hydrogen atom or a straight chain or branched chain alkylene group having 1 to 10 carbon atoms which may be substituted by a substituent group, preferably having 1 to 5 carbon atoms.

The substituent group for R is a carboxyl group, a sulfo group, a phosphono group, a phosphinic acid residue, a hydroxyl group, an amino group which may have an alkyl substituent group, an ammonio group which may have an alkyl substituent group, a carbamoyl group which may have an alkyl substituent group, a sulfamoyl group which may have an alkyl substituent group or an alkylsulfonyl group which may have a substituent group, an acylamino group, an alkylsulfonylamino group, an arylsulfonyl group, a nitro group, a cyano group or a halogen atom. R may have two or more substituent groups. Preferred examples of R include hydrogen, carboxymethyl, carboxyethyl, carboxypropyl, sulfoethyl, sulfopropyl, sulfobutyl, phosphonomethyl, phosphonoethyl and hydroxyethyl. In particular, hydrogen, carboxymethyl, carboxyethyl, sulfoethyl, sulfopropyl, phosphonomethyl and phosphonoethyl are preferable among others. L and R may combine together to form a 5-membered or 6-membered ring. These compounds may form salts in the same manner as with the above-described sulfinates.

Specific examples of the substituted hydroxylamines represented by formula (I) for use in the present invention include, but are not limited to, the following compounds:

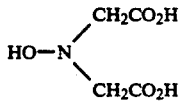

(I-1)

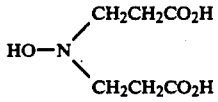

(I-2)

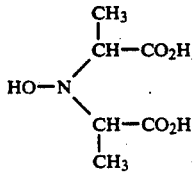

(I-3)

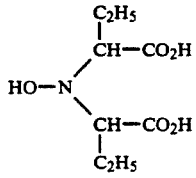

(I-4)

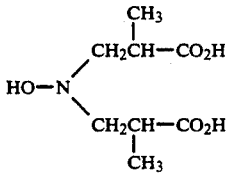

(I-5)

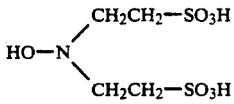

(I-6)

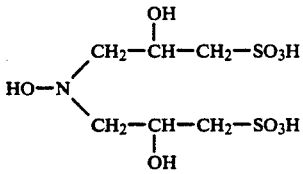

(I-7)

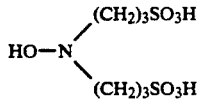

(I-8)

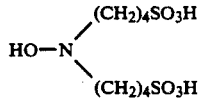

(I-9)

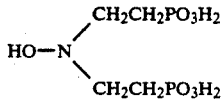

(I-10)

-continued
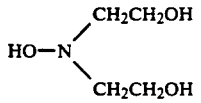
(I-11)
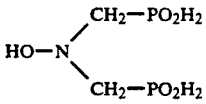
(I-12)
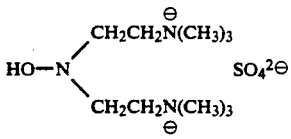
(I-13)
$HO-NH-CH_2CO_2H$ (I-14)
$HO-NH-CH_2CH_2CO_2H$ (I-15)
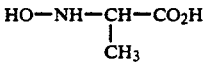
(I-16)
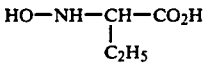
(I-17)
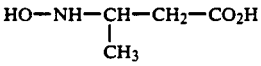
(I-18)
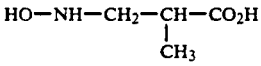
(I-19)
$HO-NH-CH_2CH_2SO_3H$ (I-20)
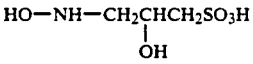
(I-21)
$HO-NH-(CH_2)_3-SO_3H$ (I-22)
$HO-NH-(CH_2)_4SO_3H$ (I-23)
$HO-NH-CH_2PO_3H_2$ (I-24)
(I-25)
$HO-NH-CH_2CH_2PO_3H_2$ (I-26)
$HO-NH-CH_2CH_2OH$ (I-27)
$HO-NH-(CH_2)_3OH$ (I-28)
$HO-NH-CH_2-PO_2H_2$ (I-29)
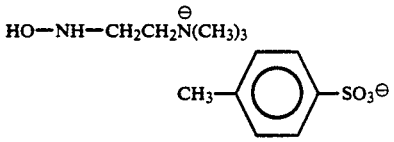
(I-30)
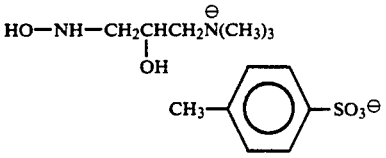
(I-31)
-continued
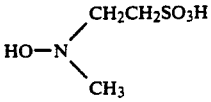
(I-32)
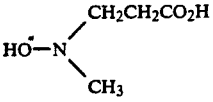
(I-33)
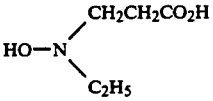
(I-34)
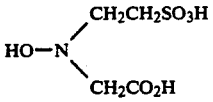
(I-35)
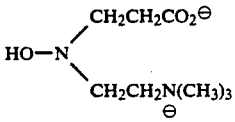
(I-36)
$HONHCH_2CH(PO_3H_2)_2$ (I-37)
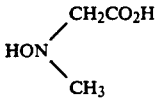
(I-38)
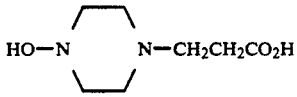
(I-39)
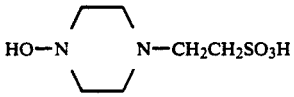
(I-40)
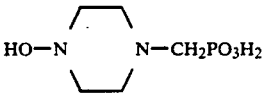
(I-41)
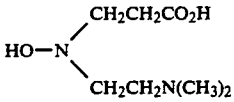
(I-42)
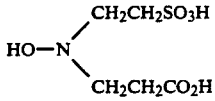
(I-43)
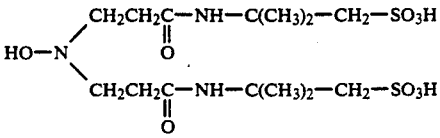
(I-44)
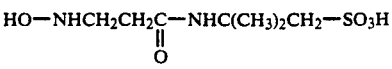
(I-45)

-continued

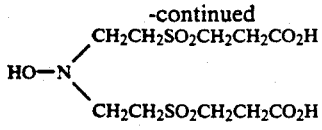

(I-46)

The compounds represented by formula (I) can be synthesized by alkylating commercial hydroxylamines (nucleophilic displacement reaction, addition reaction, Mannich reaction), in accordance with methods described in West German Patent 1,159,634 and *Inorganica Chimica Acta,* 93, 101-108 (1984).

The alkylated hydroxylamines may be added to the low and/or high pH replenisher in an amount of from 0.005 to 1 mol/l, preferably from 0.01 to 0.5 mol/l.

In the present invention, a sulfinic acid or salt thereof is preferably added to the low pH replenisher containing the developing agent to improve the stability of the color developing solution by preventing deterioration of the developing agent contained in the color developing solution. Such sulfinic acids or salts thereof are particularly effective for stabilizing the replenisher containing the developing agent in high concentration in accordance with the present invention.

The sulfinic acid for use in the present invention is a compound in which at least one —$SO_2H$ group is combined with an aliphatic group, an aromatic group or a heterocyclic group.

The aliphatic group of the sulfinic acid is a straight chain, branched chain or cyclic alkyl, alkenyl or alkynyl group which may further be substituted by, for example, ethyl, t-butyl, sec-amyl, cyclohexyl or benzyl. The aromatic group may be either a carbocyclic aromatic group (for example, phenyl or naphthyl, preferably phenyl) or a heterocyclic aromatic group (for example, furyl, thienyl, pyrazolyl, pyridyl or indolyl), and may be either a monocyclic group or a polycyclic group (for example, benzofuryl or phenanthridinyl). These aromatic rings may be substituted by, for example, alkyl, alkoxy, alkylamino, or a substituent having a carboxylic acid or a salt thereof or a sulfonic acid or a salt thereof.

The above-described heterocyclic group of the sulfinic acid is preferably a cyclic group having a 3- to 10-membered ring composed of atoms selected from carbon, oxygen, nitrogen and sulfur. The heterocyclic group may be either saturated or unsaturated, and may be substituted by, for example, chromanyl, pyrrolidyl, pyrrolinyl or morpholinyl. The number of groups of sulfinic acid or salt thereof is preferably from 1 to 3, more preferably from 1 to 2. The sulfinate for use in the present invention include alkaline metal salts, alkaline earth metal salts, nitrogen-containing organic salts and ammonium salts of the above-described sulfinic acids, wherein the alkaline metals include Na, K and Li, and the alkaline earth metals include Ca and Ba. Furthermore, ordinary amines which can form a salt with the sulfinic acid correspond to the nitrogen-containing organic salts. When a plurality of —$SO_2H$ groups are contained in a molecule, either all or a part of them may be in the form of a salt.

Of the above-described sulfinic acids, compounds having a —$SO_2H$ group combined with an aromatic group or heterocyclic ring are preferable in terms of stain prevention effect. The alkaline metal salts, the alkaline earth metal salts, the nitrogen-containing organic salts and the ammonium salts are preferably used. More preferably, compounds having a —$SO_2H$ group combined with an aromatic group (particularly, phenyl) are used, and the alkaline metal salts or alkaline earth metal salts thereof are preferable. In other words, the alkaline metal salts or the alkaline earth metal salts of the aromatic sulfinic acids are preferred.

The total number of carbon atoms contained in the sulfinic acid is preferably 20 or less to provide good water solubility in water, and depends on the number of hydrophilic substituent groups. Sulfinic acids having 1 to 15 carbon atoms, salts thereof and precursors thereof are particularly preferable. Specific non-limiting examples of the sulfinic acid and the salts thereof for use in the present invention are listed below:

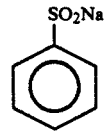

(S-1)

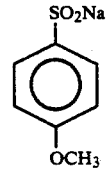

(S-2)

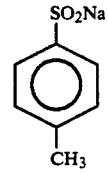

(S-3)

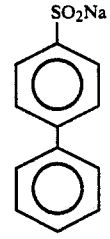

(S-4)

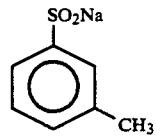

(S-5)

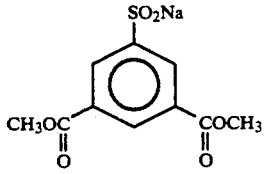

(S-6)

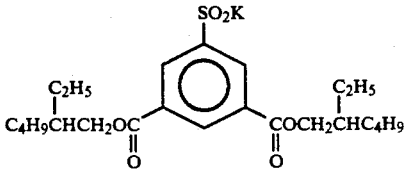

(S-7)

-continued
(S-8)
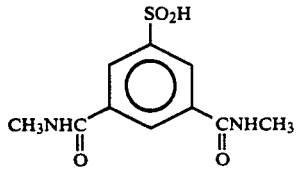
(S-9)
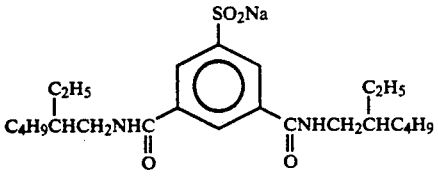
(S-10)
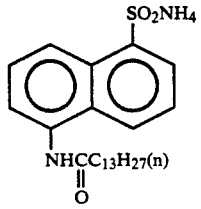
(S-11)
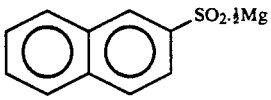
(S-12)
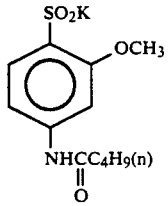
(S-13)
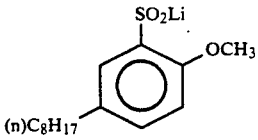
(S-14)
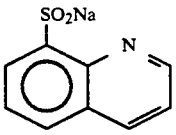
(S-15)
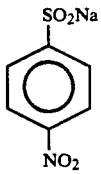
(S-16)
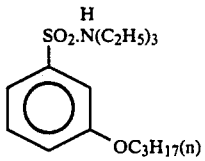
-continued
(S-17)
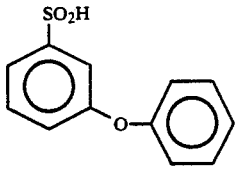
(S-18)
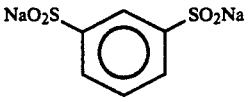
(S-19)
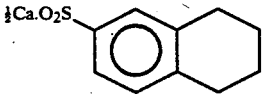
(S-20)
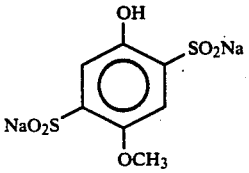
(S-21)
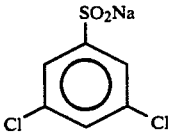
(S-22)
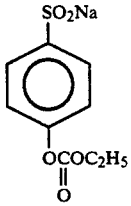
(S-23)
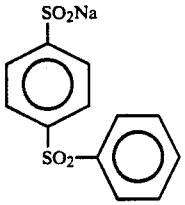
(S-24)
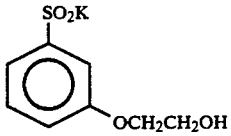
(S-25)
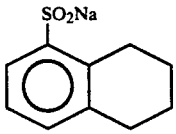
(S-26)
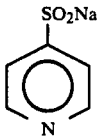

-continued
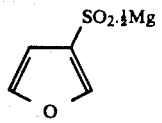
(S-27)
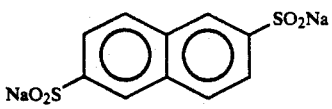
(S-28)
$(n)C_4H_9SO_2Na$ (S-29)
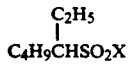
(S-30)
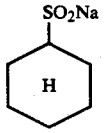
(S-31)
$CH_3OCH_2CH_2OCH_2CH_2SO_2NH_4$ (S-32)
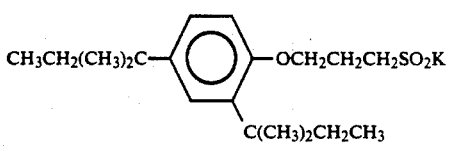
(S-33)
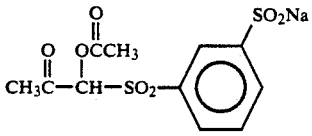
(S-34)
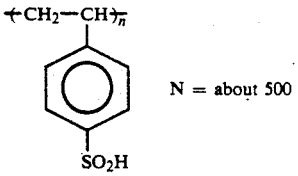
(S-35)
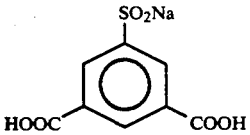
(S-36)
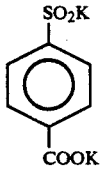
(S-37)
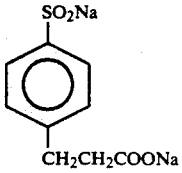
(S-38)
-continued
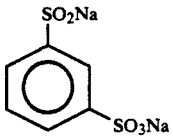
(S-39)
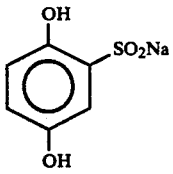
(S-40)
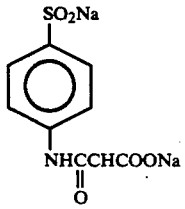
(S-41)
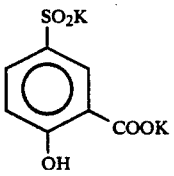
(S-42)
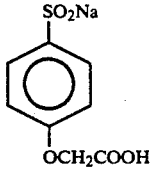
(S-43)
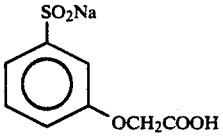
(S-44)
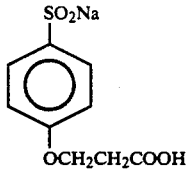
(S-45)
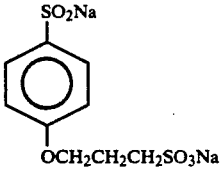
(S-46)
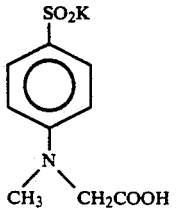
(S-47)

-continued

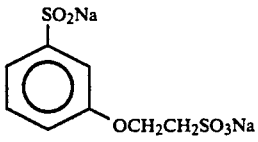

(S-48)

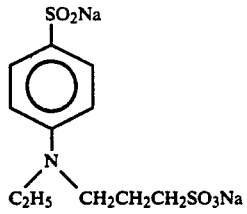

(S-49)

The above-described sulfinic acids may be used alone or in a combination of two or more kinds thereof.

The above-described sulfinic acids can be synthesized, for example, by the method described in JP-A-62-143048, J. Am. Chem. Soc., 72, 1215 (1950), ibid., 62, 2596 (1940), ibid., 60, 544 (1938), ibid., 56, 1382 (1934), ibid., 57, 2166 (1935), ibid., 81, 5430 (1959) and Chem. Rev., 48, 69 (1951) and by similar methods.

The content in the low pH replenisher of the sulfinic acid for use in the present invention is 0.001 to 1.0 mol/l, and preferably 0.002 to 0.2 mol per liter of the replenisher.

In the present invention, the color developing solution preferably contains chloride ion in an amount of $3.5\times10^{-3}$ to $3.0\times10^{-1}$ mol/l, particularly in an amount of $1.0\times10^{-2}$ to $2.0\times10^{-1}$ mol/l. If the concentration of chlorine ion is higher than $3.0\times10^{-1}$ mol/l, development is disadvantageously retarded, which is unfavorable for attaining the objectives of the present invention; namely, rapid processing and high concentration of the developer replenisher. A chloride ion concentration lower than $3.5\times10^{-}$ mol/l is unfavorable for prevention of fogging.

In the present invention, the color developing solution preferably contains bromide ion in an amount of $0.5\times10^{-5}$ to $1.0\times10^{-3}$ mol/l, particularly in an amount of $3.0\times10^{-5}$ to $5.0\times10^{-4}$ mol/l. If the concentration of bromide ion is higher than $1.0\times10^{-3}$ mol/l, development is retarded, and the maximum concentration and the sensitivity are decreased. If the concentration is lower than $0.5\times10^{-5}$ mol/l, fogging is not sufficiently prevented.

The chloride ion and the bromide ion may be directly added to the developing solution, or they may be eluted from the photographic material to the developing solution.

When the chloride ion is directly added to the color developing solution, chloride ion supply materials include sodium chloride, potassium chloride, ammonium chloride, lithium chloride, nickel chloride, magnesium chloride, manganese chloride, calcium chloride and cadmium chloride. Of these materials, sodium chloride and potassium chloride ar preferably used.

The chloride ion may also be supplied from fluorescent brighteners added to the developing solution.

Bromide ion supply materials include sodium bromide, potassium bromide, ammonium bromide, lithium bromide, calcium bromide, magnesium bromide, manganese bromide, nickel bromide, cadmium bromide, cerium bromide and thallium bromide. Of these materials, potassium bromide and sodium bromide are preferably used.

When the chloride ion and the bromide ion are eluted from the photographic material during developing processing, both may be supplied from the emulsion layers or from portions of the photographic material other than the emulsion layers.

The pH of the color developing solution for use in the present invention is preferably 9 to 12 and more preferably 9 to 11. Known additives for color developing solutions can be added to the color developing solution of the present invention.

Various buffers are preferably used to maintain the pH of the color developing solution. Useful buffers include carbonates, phosphates, borates, tetraborates, hydroxybenzoates, glycyl salts, N,N-dimethyl-glycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. In particular, carbonates, phosphates, tetraborates and hydroxybenzoates have the advantage of excellent solubility and buffering ability in the high pH region of 9.0 or more, exert no adverse effect on photographic properties (such as fogging) by addition to the color developing solutions, and are inexpensive. Therefore, these buffers are particularly preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the buffers for use in the present invention are not limited to these compounds.

The buffer is added to the color developing solution preferably in an amount of at least 0.1 mol/l, and particularly preferably in an amount of 0.1 to 0.4 mol/l.

In addition, various chelating agents can be used in the color developing solution as a suspending agent for calcium or magnesium, or to improve the stability of the color developing solution. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycoletherdiaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl-)ethylenediamine-N,N'-diacetic acid and 1,2-hydroxybenzene-4,6-disulfonic acid.

Two or more kinds of these chelating agents may be used in combination, as needed.

The chelating agent is added in an amount sufficient to block metal ions in the color developing solution. For example, the chelating agent is generally added in an amount of about 0.1 to 10 g per liter of the color developing solution.

Known development accelerators may be added to the color developing solution as needed.

Useful development accelerators include thioether compounds described in JP-B-37-16088, JP-B-37-5987, JP-B-38-7826, JP-B-44-12380, JP-B-45-9019, and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; amine compounds described in U.S. Pat. Nos. 2,494,903, 3,128,182, 4,230,796, 3,253,919, 2,482,546, 2,596,926 and 3,582,346 and JP-B-41-11431; polyalkylene oxides described in JP-B-37-16088, JP-B-42-25201, U.S. Pat. No. 3,128,183, JP-B-41-11431, JP-B-42-23883 and U.S. Pat. No. 3,532,501; 1-phenyl-3-pyrazolidone compounds; imidazole compounds; and ascorbic acid.

In replenishment of the color developing solution, known antifoggants may be added as needed. Useful antifoggants include alkaline metal halides such as sodium chloride, potassium bromide, potassium iodide, and organic antifoggants. Typical examples of the antifoggants include nitrogen-containing heterocyclic compounds such as benzotriazole, 6-nitrobenz-imidazole, 5-nitroisoindazole, 5-methylbenzotriazole, 5-nitrobenzotriazole, 5-chlorobenzotriazole, 2-thiazolyl-benzimidazole, 2-thiazolylmethylbenzimidazole, indazole, hydroxyazaindolizine and adenine.

The color developing solution of the present invention preferably contains a fluorescent brightener. Preferred fluorescent brighteners are 4,4'-diamino-2,2'-disulfostilbene compounds. The fluorescent brightner is added in an amount of from 0 to 5 g, and preferably in an amount of from 0.1 to 4 g, per liter of the color developing solution.

Various known water-soluble polymers and surface active agents may be added to the color developing solution as needed. Examples of useful water-soluble polymers include polyvinyl alcohols, polyacrylic acids, polystyrenesulfonic acids, polyacrylamides, polyvinylpyrrolidones and copolymers thereof. Examples of useful surface active agents include alkylsulfonic acids, arylphosphonic acids, aliphatic carboxylic acids, aromatic carboxylic acids and polyethylene oxides.

The processing temperature for color developing in the present invention is from 20° to 50° C., and preferably from 30° to 45° C. The processing time is generally 5 to 120 seconds, and preferably 10 to 60 seconds. The replenishment rate of the color developing solution is preferably minimized. The replenishment rate for each of the low and high pH replenishers is however suitably from 20 to 600 ml/m$^2$, preferably up to 100 ml/m$^2$ of the photographic material processed, and more preferably from 5 to 50 ml/m$^2$ or less. When evaporation loss and carryover are taken into account the total replenishment rate is preferably 25 ml/m$^2$ or more. The effects of the present invention become pronounced when the replenishment rate is 60 ml/m$^2$ or less.

The color development efficiency of the present invention is relatively superior to combinations other than those of the present invention, even if the solution open ratio [air contacting area (cm$^2$)/solution volume (cm$^3$)] has a finite value. However, the solution open ratio is preferably 0 to 0.1 cm$^{-1}$ to promote stability of the color developing solution. In continuous processing, the processing solution open ratio is practically within the range of from 0.001 to 0.05 cm$^{-1}$. More preferably, the open ratio is 0.002 to 0.03 cm$^{-1}$.

Desilverization for use in the present invention is described below. The desilverization may be carried out using any of a bleaching stage-fixing stage, a fixing stage-bleach-fixing stage, a bleaching stage-bleaching-fixing stage and a bleach-fixing stage.

Bleaching solutions, bleach-fixing solutions and fixing solutions for use in the present invention are illustrated below.

Known bleaching agents can be used in the bleaching solution or the bleach-fixing solution. In particular, preferred bleaching agents include organic complexes of iron (III) (for example, complex salts of iron (III) with aminopolycarboxylic acids such as ethylenediaminetetraacetic acid and diethylenetriamine-pentaacetic acid, aminopolyphosphonic acids, phosphonocarboxylic acids and organic phosphonic acids); organic acids (such as citric acid, tartaric acid and malic acid), persulfates; and hydrogen peroxide.

Of these, the organic complex salts of iron (III) are preferable for rapid processing and prevention of environmental pollution. The aminopolycarboxylic acids, aminopolyphosphonic acids and organic phosphonic acids useful for formation of the organic complex salts of iron (III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycoletherdiaminetetraacetic acid. These compounds may be any of a sodium, potassium, lithium and ammonium salt. Of these compounds, the complex salts of iron (III) with ethylenediaminetetraacetic acid, diethylenetriamine-pentaacetic acid, cyclohexanediaminetetraacetic acid, 1,3-diaminopropanetetraacetic acid and methyliminodiacetic acid are preferable because of their high bleaching ability. The complex salts of iron (III) may be used in the form of complex salts, or the complex salts of iron (III) may be formed in the processing solution by separately adding a ferric salt such as ferric sulfate, ferric chloride, ferric nitrate, ammonium ferric sulfate and ferric phosphate, and a chelating agent such as a aminopolycarboxylic acid, aminopolyphosphonic acid and phosphonocarboxylic acid. The chelating agent may be used in an amount in excess of the equivalent amount for formation of the complex salt of iron (III). Of the iron complexes, iron complexes with an aminopoly-carboxylic acids are preferably used and contained in the processing solution having a bleaching ability in an amount of 0.01 to 1.0 mol/l, and preferably in an amount of 0.05 to 0.50 mol/l.

The processing conditions for bleach-fixing in the present invention are from 5 to 120 seconds, and preferably from 10 to 60 seconds, from 25° to 60° C., and preferably from 30° to 50° C. The replenishment rate is from 20 to 250 ml, and preferably from 30 to 100 ml, per m$^2$ of the photographic material.

Various compounds may be added as bleaching promoters to the bleaching solution, the bleach-fixing solution and/or the preceding baths thereof. For example, the compounds having a mercapto group or disulfide linkage described in U.S. Pat. No. 3,893,858, West German Patent 1,290,812, JP-A-53-95630 and *Research Disclosure* No. 17129 (July, 1978), the thiourea compounds described in JP-B-45-8506, JP-A-52-20832, JP-A-53-32735 and U.S. Pat. No. 3,706,561 and halides which provide iodide ion or bromide ion are preferred as having excellent bleaching ability.

In addition, the bleaching solution or bleach-fixing solution for use in the present invention may contain a rehalogenating agent such as a bromide (for example, potassium bromide, sodium bromide and ammonium bromide), a chloride (for example, potassium chloride, sodium chloride and ammonium chloride) and or iodide (for example, ammonium iodide). One or more kinds of inorganic acids, organic acids and alkali metal or ammonium salts thereof having a pH buffering ability such as borax, sodium metaborate, acetic acid, sodium acetate, sodium carbonate, potassium carbonate, phosphorous acid, phosphoric acid, sodium phosphate, citric acid, sodium citrate and tartaric acid, or a corrosion inhibitor such as ammonium nitrate and guanidine can be added as needed.

Fixing agents for use in the bleach-fixing solution or the fixing solution are fixing agents known in the art, namely, water-soluble silver halide dissolving agents such as thiosulfates (for example, sodium thiosulfate and ammonium thiosulfate), thiocyanates (for example, sodium thiocyanate and ammonium thiocyanate), thioether compounds (for example, ethylenebisthioglycollic acid and 3,6-dithia-1,8-octanediol), and thioureas. These compounds may be used alone, or as mixtures of two or more kinds thereof. A special bleaching-fixing solution can also be used which is prepared by a combination of the fixing agent described in JP-A-55-155354 with a halide in large quantity such as potassium iodide. In the present invention, the thiosulfates are preferred, and particularly, ammonium thiosulfate is preferred. The fixing agent is preferably added in an amount of 0.3 to 2 mol/l, and more preferably in an amount of 0.5 to 1.0 mol per liter of the bleach-fixing solution or the fixing solution. The pH range of the bleach-fixing solution or the fixing solution is preferably 3 to 10, and more preferably 4 to 7.

The fixing process in the present invention is carried out for from 5 to 120 seconds, and preferably from 10 to 60 seconds at from 25 to 60° C., and preferably from 30° to 50° C. The replenishment rate of the fixing solution is from 20 to 250 ml, and preferably from 30 to 100 ml/$m^2$ of the photographic material.

The bleach-fixing solution may further contain various known fluorescent brighteners, antifoaming agents, surface active agents and organic solvents such as polyvinyl pyrrolidone and methanol.

The bleach-fixing solution or the fixing solution preferably contains a sulfite ion-releasing compound such as a sulfite (for example, sodium sulfite, potassium sulfite and ammonium sulfite), a bisulfite (for example, ammonium bisulfite, sodium bisulfite and potassium bisulfite) and metabisulfites (for example, potassium metabisulfite, sodium metabisulfite and ammonium metabisulfite). The sulfite ion-releasing compound is contained preferably in an amount of about 0.02 to 0.05 mol/l and more preferably in an amount of 0.04 to 0.40 mol/l, based on the sulfite ion content.

As a preservative, sulfites can generally be added. In addition, ascorbic acid, carbonyl bisulfite addition compounds or carbonyl compounds may be added to the bleach-fixing solution or fixing solution.

Known buffers, fluorescent brighteners, chelating agents, antifoaming agents, antifungal agents or the like may be further added to the bleach-fixing solution or fixing solution as needed.

The processing time in the bleach-fixing solution for use in the present invention is 5 to 120 seconds, and preferably 10 to 60 seconds. The bleach-fixing solution is used at a temperature of 25° to 60° C., and preferably at a temperature of 30° to 50° C. The replenishment rate is 20 to 50 ml per $m^2$ of the photographic material processed, and preferably 30 to 100 ml per $m^2$.

The silver halide color photographic material is usually subjected to washing and/or stabilizing processing after desilverization (the washing processing also includes the stabilizing processing, unless indicated otherwise).

The amount of washing water used in the washing stage depends on the characteristics of the photographic material (for example, constituent components such as couplers), application thereof, the temperature of the rinsing water, the number of rinsing tanks (the number of stages), the use of a countercurrent or following current replenishment system and other considerations. Of these, the relationship between the amount of the washing water and the number of the rinsing tanks in a multistage countercurrent system can be determined by the method described in *Journal of the Society of Motion Picture and Television Engineers*, 64, 248–253 (May, 1955). Usually, the number of the stages in the multistage countercurrent system is preferably 2 to 6, and particularly preferably 2 to 5.

By using the multistage countercurrent system, the amount of the washing water can be substantially reduced. For example, the amount of the washing water can be reduced to 0.5 to 1 l per $m^2$ of photographic material processed. The effect of the present invention is remarkable in this aspect. However, the increased residence time of the washing water in the tanks results in the proliferation of bacteria and the resulting suspended matter adheres onto the photographic material. In order to solve this problem, the method for reducing calcium and magnesium concentrations as described in JP-A-62-288838 can be very effectively used. Disinfectants can also be used, which include the isothiazolone compounds and the thiapentazoles described in JP-A-57-8542; chlorine disinfectants such as chlorinated sodium isocyanurate described in JP-A-61-120145; benzotriazole described in JP-A-61-267761; copper ions and the disinfectants described in Hiroshi Horiguchi, *Chemistry of Bacteria Prevention and Fungus Prevention*, Sankyo Shuppan (1986), *Sterilization, Pasteurization and Fungus Prevention Techniques of Microorganisms*, edited by Eisei Gijutsukai, Kogyo Gijutsukai (1982) and *Dictionary of Disinfectants and Fungicides*, edited by Nippon Bohkin Bohbai Gakkai (1986).

In addition, surface active agents can be used as wetting agents in the washing water, and chelating agents such as EDTA as water softeners.

The photographic material can be treated successively by the washing stage described above, or directly with a stabilizing solution without passing through a water washing stage. Compounds having an image stabilizing function are generally added to the stabilizing solution. Examples of such compounds include aldehyde compounds represented by formalin, buffers for adjusting the finished print to a pH suitable for dye stabilization, and ammonium compounds. In order to prevent bacteria from proliferating in the processing solutions and to provide an antifungal property to the treated photographic material, the various above-described disinfectants and antifungal agents can be used.

Surface active agents, fluorescent brighteners or hardening agents may be further added to the stabilizing solution. In the processing of the photographic material according to the present invention, when stabilization is directly performed without passing through the washing stage, all of the methods described in JP-A-57-8543, JP-A-58-14834 and JP-A-60-220345 can be used.

In the present invention, water for washing and/or stabilization may be water treated with a reverse osmosis membrane. Useful reverse osmosis membrane materials include cellulose acetates, crosslinked polyamides, polyethers, polysulfones, polyacrylic acids and polyvinylene carbonates. In particular, crosslinked polyamide membranes and polysulfone membranes are preferably used because their water permeation amount is not considerably decreased.

A low pressure reverse osmosis membrane can be used for a low liquid-transferring pressure of 2 to 15 kg/cm$^2$ in terms of reduction of initial apparatus cost, reduction of operating cost, miniaturization and noise reduction of a pump. The reverse osmosis membranes are preferably formed by spirally rolling flat membranes, such that the water permeation amount is not considerably decreased.

When these membranes are used, the liquid-transferring pressure is within the range described above. However, the pressure is preferably 2 to 10 kg/cm$^2$, and more preferably 3 to 7 kg/cm$^2$, to prevent stains and a decrease in the water permeation amount.

The washing and/or stabilizing stage is preferably conducted as a multistage countercurrent system using a plurality of tanks. It is particularly preferred to use 2 to 5 tanks.

The treatment with the reverse osmosis membrane is preferably applied to water of the second and later tanks for washing and/or stabilization on such a multistage counter-current system. Specifically, water in the second tank for a 2-tank system, in the second or third tank for 3-tank system, and in the second, third or fourth tank for 4-tank constitution is treated with the reverse osmosis membrane, and permeated water is returned to the same tank (a tank in which water for treatment with a reverse osmosis membrane is collected; hereinafter referred to as a collection tank) or a subsequent washing and/or stabilizing tank.

The washing baths for use in the present invention may contain chelating agents. Useful chelating agents include aminopolycarboxylic acids, aminopolyphosphonic acids, phosphonocarboxylic acids, alkylidenediphosphonic acids, metaphosphoric acid, pyrophosphoric acid, organic phosphonic acids and salts thereof, and polyphosphoric acids. Addition of the organic phosphonic acid compounds described in JP-A-3-245141 is particularly preferred.

The amount of these organic phosphonic acid and/or organic phosphonate added to the washing bath or the stabilizing bath can be determined depending on the amount of ethylenediaminetetraacetic acid Fe (III) remaining in the photographic material. It is however preferably 2.9 to 290 mol per liter of the water washing bath or stabilizing bath, more preferably from 14.6 to 146 mmol/l. If the organic phosphonic acid and/or the organic phosphonate are added in too large an amount, the surfaces of the photographic material tend to become sticky. Conversely, if added in too small an amount, the essential stain prevention effect is not obtained.

Further, the use of magnesium or bismuth compounds in the water washing and/or stabilization baths is a preferred embodiment of the present invention.

In addition, the addition of chelating agents such as 1-hydroxyethylidene-1,1-diphosphonic acid and ethylenediaminetetramethylenephosphonic acid, magnesium or bismuth compounds to the water washing and/or stabilization baths is also a preferred embodiment of the present invention.

As a washing solution or stabilizing solution for use after desilverization, a rinsing solution may be similarly used.

The pH of the washing solution or the stabilizing solution is preferably 4 to 10 and more preferably 5 to 8. The temperature thereof is selected depending on the application of the photographic material, the characteristics thereof and the like. However, the temperature is generally 30° to 60° C., and preferably 35° to 50° C. The time required for washing is not particularly restricted, but a shorter time is preferable for reducing the processing time. The washing time is therefore preferably 5 to 45 seconds and more preferably 10 to 35 seconds. In terms of operating cost, reduction in discharge and processability, the washing bath replenishment rate is preferably minimized.

A preferred replenishment rate of the washing bath is 0.5 to 50 times and preferably 2 to 15 times the amount of the solution carried over from the preceding bath per unit area of photographic material, or not more than 300 ml and preferably not more than 150 ml per m$^2$ of photographic material processed. The replenishment may be carried out continuously or intermittently.

The solution used in the washing stage and/or the stabilizing stage can be further used in a preceding stage. Examples thereof include the method of introducing overflow washing water of a multistage countercurrent system into the preceding bath (e.g., the bleach-fixing bath), and replenishing the bleaching-fixing bath with a concentrated solution, to thereby reduce the amount of waste liquid.

In the present invention, the washing solution and/or the stabilizing solution and the other processing solutions may be applied using a jet stream. The jet stream can be generated by sucking the solution out from the processing tank with a pump, and ejecting the solution toward an emulsion surface of a photographic material through a nozzle or a slit which is located opposite to the emulsion surface. More specifically, the method described in the example of JP-A-62-183460, page 3, lower right column to page 4, lower right column can be employed.

In the present invention, the processing time is defined as the time the photographic material comes into contact with the color developing solution until the time the photographic material leaves the last processing tank (generally, the washing and/or stabilizing bath). The effects of the present invention are pronounced in rapid processing when the total processing time is 3 minutes or less, and preferably 1 minute and 30 seconds or less.

A drying stage applicable to the present invention is described below.

The drying time is desirably 20 to 40 seconds to be compatible with the very rapid processing of the present invention.

The drying time can be shortened by decreasing the amount of hydrophilic binder such as a gelatin contained in the photographic material, to thereby reduce the amount of water introduced into the color paper. For reducing the amount of absorbed water in processing, it is also possible to speed up drying by removing absorbed water with a squeezing roller or a cloth immediately after the photographic material leaves the washing bath. It is also possible to increase the drying rate by elevating the temperature of a dryer or by increasing the flow rate of the drying air. Drying can also be quickened by adjusting the incidence angle of the drying air to the photographic material and by exhausting moisture laden air.

Preferred embodiment of the present invention are illustrated below by reference to the accompanying drawings.

Figure 2:
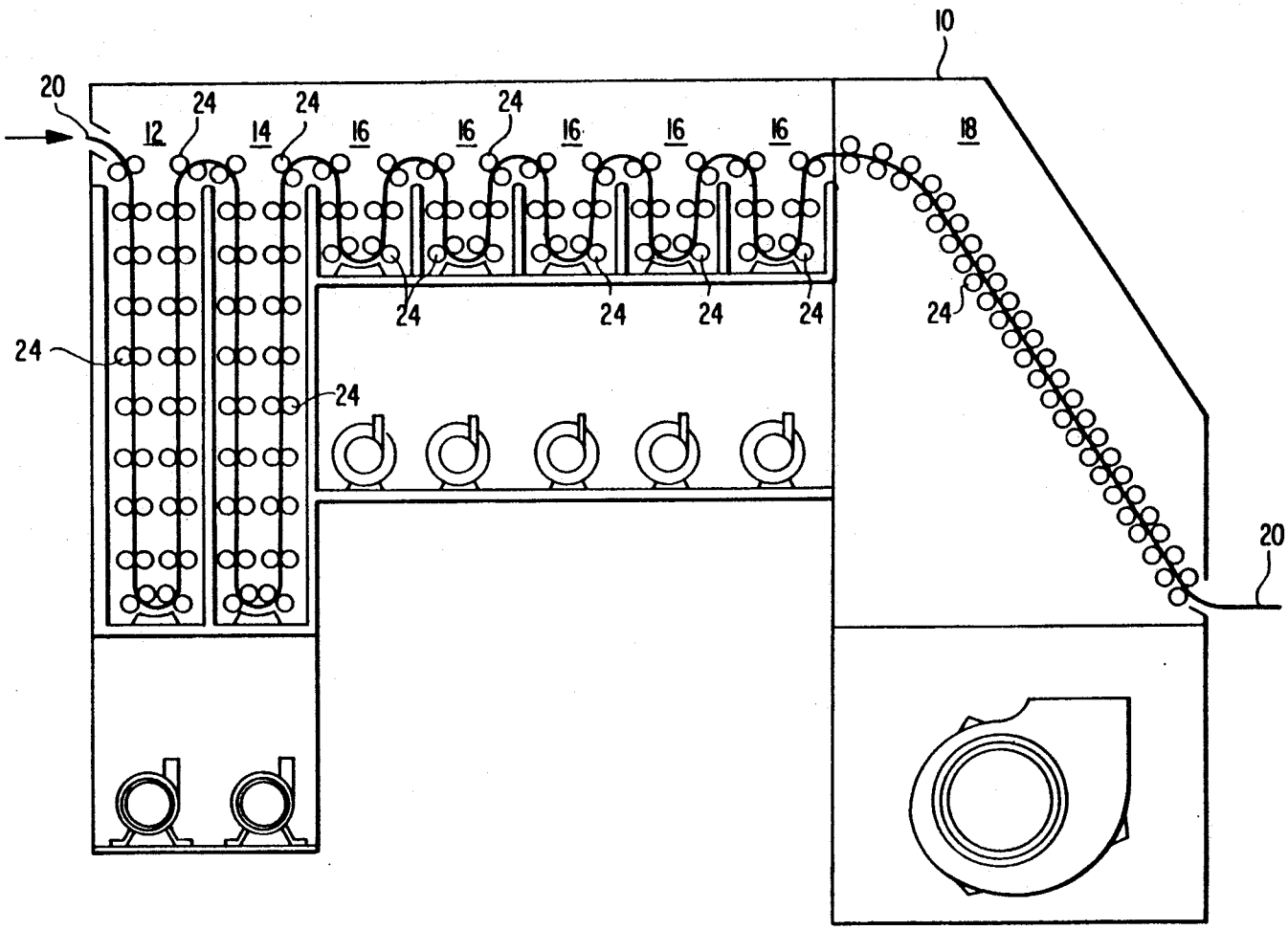
FIG. 2 is a schematic view showing an apparatus for processing photographic materials for use in the present invention.

FIG. 2 is a schematic view showing a preferred embodiment of the present invention, namely, a silver salt photographic color paper processing apparatus provided with a device for replenishing the developing bath. Using this apparatus, exposed color paper can be developed, bleach-fixed and washed with water, followed by drying to form images on the color paper.

A main body 10 of the apparatus is provided with a developing tank 12, a bleach-fixing tank 14, a plurality of washing tanks 16, and a drying unit 18, in order of machine direction. Exposed color paper (hereinafter referred to as a photographic material) 20 is developed, bleach-fixed and washed, followed by drying. Then, the photographic material is discharged from the main body 10. The number of the washing tanks 16 is 3 to 5. The developing tank 12, the bleaching-fixing tank 14, the washing tanks 16 and the drying unit 18 are provided with transferring roller pairs 24 for transferring the photographic material 20 in each processing portion. The photographic material is held between the roller pairs. The photographic material 20 is immersed in the processing solutions for predetermined periods of time while being held and transferred by the transferring roller pairs 24, to thereby carry out the color developing process.

FIG. 1 is a schematic view showing a device for replenishing a developing bath attached to the developing tank 12. The developing tank 12 is shown as a cross-sectional side view.

A first replenisher tank 30 is filled with a low pH replenisher (a first replenisher) containing a developing agent in high concentration, and a second replenisher tank 32 is filled with a high pH replenisher (a second replenisher) containing a preservative, a chelating agent and a salt. The replenishers in the respective replenisher tanks 30 and 32 are supplied to the developing tank 12 through pumps 42 and 44 fitted to supply pipes 36 and 38, respectively. Driving means 48 and 50 of the respective pumps 42 and 44 are connected to a controller 54, and the operation of the pumps 42 and 44 are controlled by the controller 54.

Referring to FIG. 1, the parts of addition to the developing tank of the supply pipes 36 and 38 of both the replenishers are arranged sufficiently apart from one another such that a precipitate is not formed when the low pH replenisher and the high pH replenisher are simultaneously supplied to the developing tank (i.e., concurrently supplied).

When the low and high pH replenishers are each supplied at different time intervals (i.e., staggered intervals) by the controller 54, the supply pipes may be arranged in proximity to each other, or the replenishers may be supplied through the same pipe (i.e., a common supply pipe).

The pH of the color developing solution is usually maintained within the range of 9 to 11, and preferably within the range of 10.00 to 10.50.

EXAMPLE 1

A paper support both sides of which were laminated with polyethylene was subjected to corona discharge treatment and then provided with a gelatin underlayer containing sodium dodecylbenzenesulfonate. Various photographic constituent layers were further applied thereto. Thus, a multilayer color photographic paper having the following layer constitution was prepared. The coating solutions were prepared as follows:

Preparation of Coating Solution for First Layer 27.2 cc of ethyl acetate, 4.1 g of solvent (Solv-3) and 4.1 g of solvent (Solv-7) were added to 19.1 g of yellow coupler (ExY), 4.4 g of color image stabilizer (Cpd-1) and 0.7 g of color image stabilizer (Cpd-7) to dissolve these compounds. The resulting solution was emulsified and dispersed in 185 cc of 10 wt % gelatin solution containing 8 cc of 10 wt % sodium dodecylbenzenesulfonate to prepare emulsified dispersion A.

In the meantime, silver chlorobromide emulsion A (cubic; a 3:7 mixture (Ag molar ratio) of a large-sized emulsion A having a mean grain size of 0.88 μm and a small-sized emulsion A having a mean grain size of 0.70 μm; having coefficients of variation in grain size distribution of 0.08 and 0.10, respectively; each emulsion containing 0.3 mol % of silver bromide localized on a part of the surface of the grains) was prepared, to which each of the following blue-sensitizing dyes A and B were added in an amount of $2.0\times10^{-4}$ mol for the large-sized emulsion A and in an amount of $2.5\times10^{-4}$ mol for small-sized emulsion A. Chemical ripening of this emulsion was conducted by adding a sulfur sensitizer and a gold sensitizer. The above-described emulsified dispersion A and the silver chlorobromide emulsion A were mixed together to prepare a coating solution for a first layer having the composition shown below.

Coating solutions for the second to seventh layers were prepared in the same manner as the coating solution for the first layer. As a gelatin hardener for each layer, the sodium salt of 1-oxy-3,5-dichloro-s-triazine was used.

Cpd-10 and Cpd-11 were added to each layer in total amounts of 25.0 mg/m$^2$ and 50.0 mg/m$^2$, respectively.

In the silver chlorobromide emulsions of the respective light-sensitive emulsion layers, the following color sensitizing dyes were used.

Color Sensitizing Dye A for Blue-Sensitive Emulsion Layer

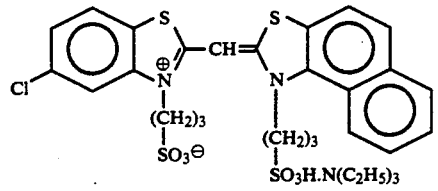

Color Sensitizing Dye B for Blue-Sensitive Emulsion Layer

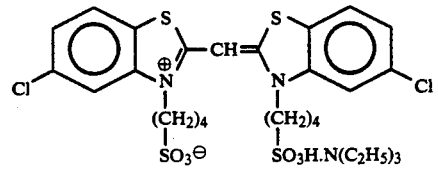

($2.0\times10^{-4}$ mol of each of Dyes A and B per mol of silver halide, for the large-sized emulsion A, and $2.5\times10^{-4}$ mol of each of Dyes A and B per mol of silver halide, for the small-sized emulsion A)

Color Sensitizing Dye C for Green-Sensitive Emulsion Layer

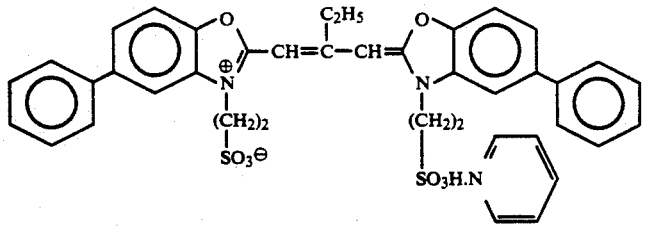

($4.0\times10^{-4}$ mol per mol of silver halide for the large-sized emulsion B, and $5.6\times10^{-4}$ mol per silver halide for the small-sized emulsion B)

Color Sensitizing Dye D for Green-Sensitive Emulsion Layer

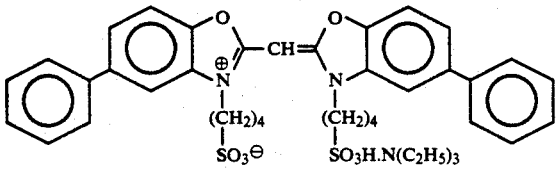

($7.0\times10^{-5}$ mol per mol of silver halide for the large-sized emulsion B, and $1.0\times10^{-5}$ mol per silver halide for the small-sized emulsion B)

Color Sensitizing Dye E for Red-Sensitive Emulsion Layer

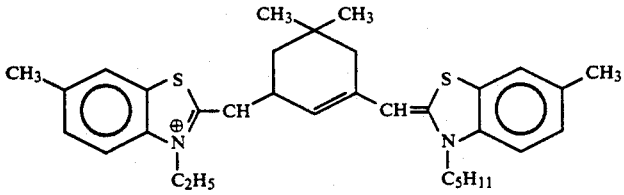

($0.9\times10^{-4}$ per mol of silver halide for the large-sized emulsion C, and $1.1\times10^{-4}$ mol per silver halide for the small-sized emulsion C)

To the red-sensitive emulsion layer was added the following compound in an amount of $2.6\times10^{-3}$ mol per mol of silver halide:

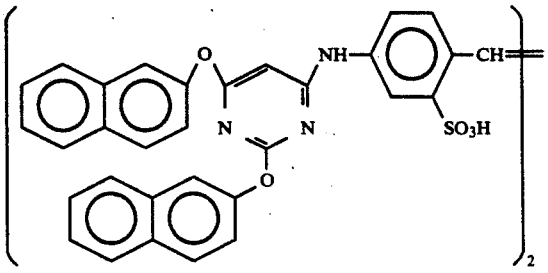

Furthermore, 1-(5-methylureidophenyl)-5-mercaptotetrazole was added to the blue-sensitive emulsion layer, the green-sensitive emulsion layer and the red-sensitive emulsion layer in amounts of $8.5\times10^{-5}$ mol, $7.7\times10^{-4}$ mol and $2.5\times10^{-4}$ mol per mol of silver halide, respectively.

Furthermore, 4-hydroxy-6-methyl-1,3,3a,7-tetraazainedene was added to the blue-sensitive emulsion layer and the green-sensitive emulsion layer in amounts of $1\times10^{-4}$ mol and $2\times10^{-4}$ mol per mol of silver halide, respectively.

The following dyes were added to each emulsion layer for prevention of irradiation (the numerical values in parentheses indicate weights of the dyes coated):

(10 mg/m$^2$)

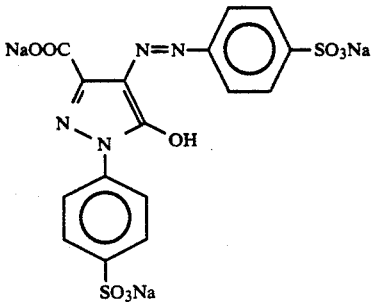

-continued

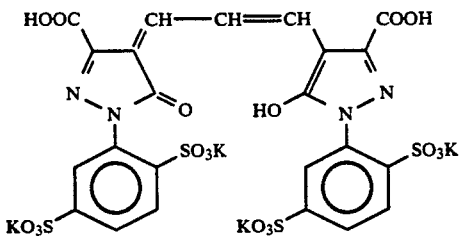

(10 mg/m²)

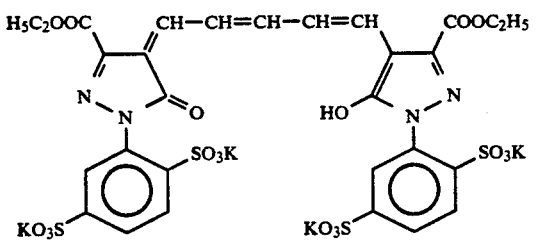

(40 mg/m²)

and

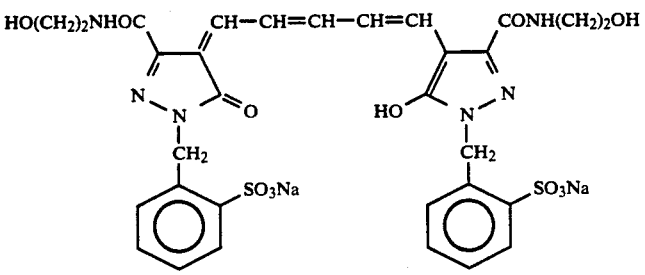

(20 mg/m²)

Layer Constitution

The composition of each layer is shown below. The numerals indicate coverage amounts (g/m²) of the components coated. For the silver halide emulsions, the numerals indicate the coverage amounts of the emulsions expressed as silver.

Support

Paper laminated with polyethylene (polyethylene on the side of the first layer containing a white pigment ($TiO_2$) and a bluing dye (ultramarine))

| | |
|---|---|
| First Layer (Blue-Sensitive Emulsion Layer) | |
| Silver Chlorobromide Emulsion A Described Above | 0.30 |
| Gelatin | 1.67 |
| Yellow Coupler (ExY) | 0.82 |
| Color Image Stabilizer (Cpd-1) | 0.19 |
| Solvent (Solv-3) | 0.16 |
| Solvent (Solv-7) | 0.16 |
| Color Image Stabilizer (Cpd-7) | 0.06 |
| Second Layer (Color Mixing Preventing Layer) | |
| Gelatin | 0.99 |
| Color Mixing Inhibitor (Cpd-5) | 0.08 |
| Solvent (Solv-1) | 0.16 |
| Solvent (Solv-4) | 0.08 |
| Third Layer (Green-Sensitive Emulsion Layer) | |
| Silver Chlorobromide Emulsion (cubic; a 1:3 mixture (Ag molar ratio) of large-sized emulsion B having a mean grain size of 0.55 μm and small-sized emulsion B having a mean grain size of 0.39 μm; having coefficients of variation in grain size distribution of 0.10 and 0.08, respectively; each emulsion containing 0.8 mol % of silver bromide localized on a part of the surface of the grains) | 0.12 |
| Gelatin | 1.11 |

-continued

| | |
|---|---|
| Magenta Coupler (ExM) | 0.23 |
| Color Image Stabilizer (Cpd-2) | 0.03 |
| Color Image Stabilizer (Cpd-3) | 0.16 |
| Color Image Stabilizer (Cpd-4) | 0.02 |
| Color Image Stabilizer (Cpd-9) | 0.02 |
| Solvent (Solv-2) | 0.36 |
| Fourth Layer (Ultraviolet Light Absorbing Layer) | |
| Gelatin | 1.26 |
| Ultraviolet Light Absorber (UV-1) | 0.47 |
| Color Mixing Inhibitor (Cpd-5) | 0.05 |
| Solvent (Solv-5) | 0.20 |
| Fifth Layer (Red-Sensitive Emulsion Layer) | |
| Silver Chlorobromide Emulsion (cubic; a 1:4 mixture (Ag molar ratio) of large-sized emulsion C having a mean grain size of 0.58 μm and small-sized emulsion C having a mean grain size of 0.45 μm; having coefficients of variation in grain size distribution of 0.09 and 0.11, respectively; each emulsion containing 0.6 mol % of silver bromide localized on a part of the surface of the grains) | 0.23 |
| Gelatin | 1.21 |
| Cyan Coupler (ExC) | 0.32 |
| Color Image Stabilizer (Cpd-2) | 0.03 |
| Color Image Stabilizer (Cpd-4) | 0.02 |
| Color Image Stabilizer (Cpd-6) | 0.18 |
| Color Image Stabilizer (Cpd-7) | 0.40 |
| Color Image Stabilizer (Cpd-8) | 0.05 |
| Solvent (Solv-6) | 0.14 |
| Sixth Layer (Ultraviolet Light Absorbing Layer) | |
| Gelatin | 0.45 |
| Ultraviolet Light Absorber (UV-1) | 0.16 |
| Color Mixing Inhibitor (Cpd-5) | 0.02 |
| Solvent (Solv-5) | 0.08 |
| Seventh Layer (Protective Layer) | |
| Gelatin | 1.20 |
| Acrylic Modified Copolymer of Polyvinyl Alcohol (degree of modification: 17%) | 0.17 |
| | 0.03 |

-continued
| |
|---|
| Liquid paraffin |
The compounds used in the above Example are shown below:
(ExY) Yellow Coupler:
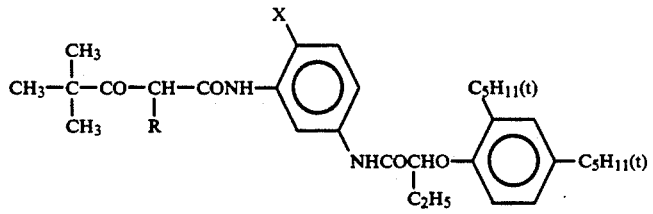
A 1:1 mixture (molar ratio) of
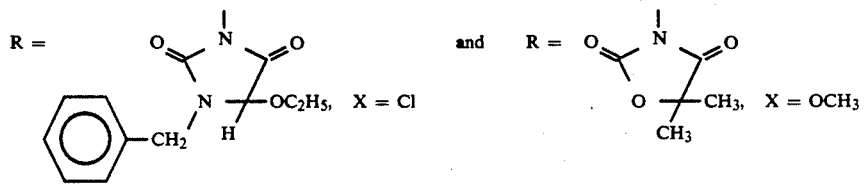
(ExM) Magenta Coupler:
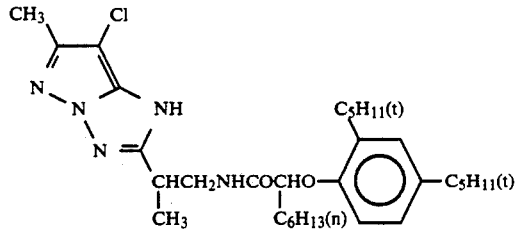
(ExC) Cyan Coupler:
A 1:1 mixture (molar ratio) of
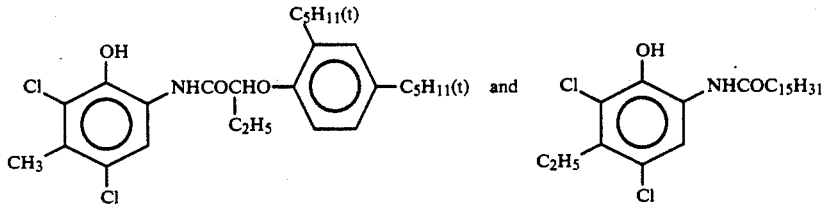
(Cpd-1) Color Image Stabilizer:
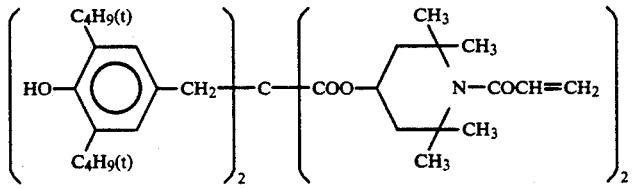
(Cpd-2) Color Image Stabilizer:
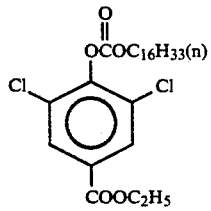

-continued
(Cpd-3) Color Image Stabilizer:
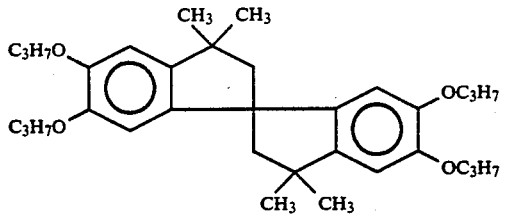
(Cpd-4) Color Image Stabilizer:
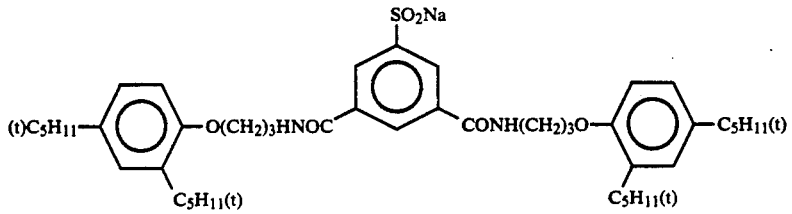
(Cpd-5) Color Mixing Inhibitor:
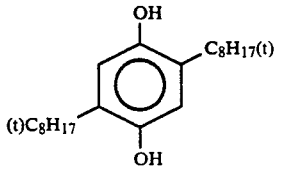
(Cpd-6) Color Image Stabilizer:
A 2:4:4 mixture (weight ratio) of
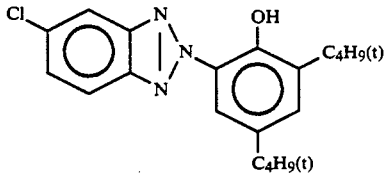
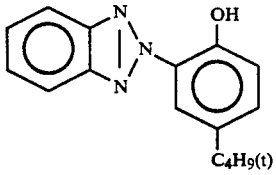
and
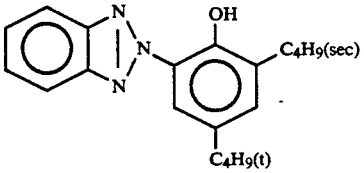
(Cpd-7) Color Image Stabilizer:
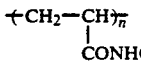
(average molecular weight: 60,000)
(Cpd-8) Color Image Stabilizer:
A 1:1 mixture (weight ratio) of -continued
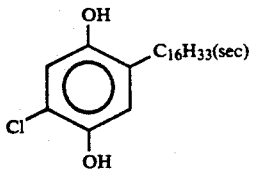
and
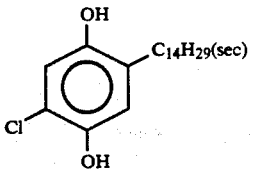
(Cpd-9) Color Image Stabilizer:
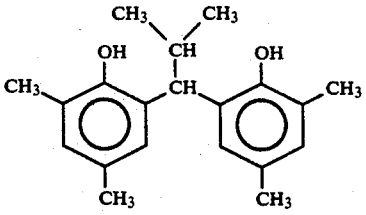
(Cpd-10) Preservative:
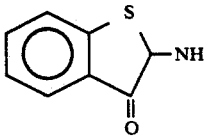
(Cpd-11) Preservative:
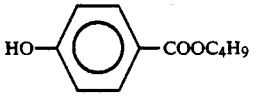
(UV-1) Ultraviolet Light Absorber:
A 4:2:4 mixture (weight ratio) of
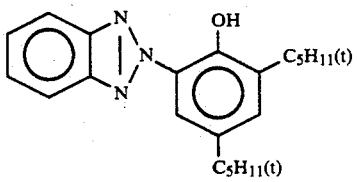
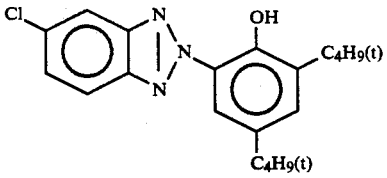
and
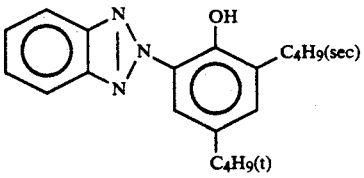
(Solv-1) Solvent:
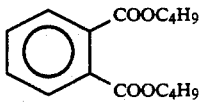

-continued (Solv-2) Solvent:

A 1:1 mixture (volume ratio) of

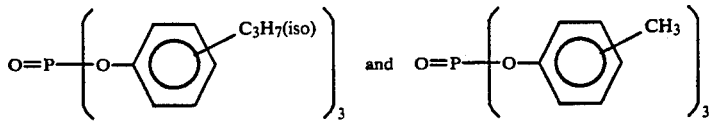

(Solv-3) Solvent:

$O{=}P{\leftarrow}O{-}C_9H_{19}(iso))_3$ (Solv-4) Solvent:

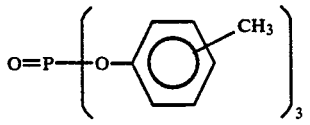

(Solv-5) Solvent:

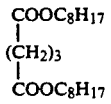

(Solv-6) Solvent:

A 80:20 mixture (volume ratio) of

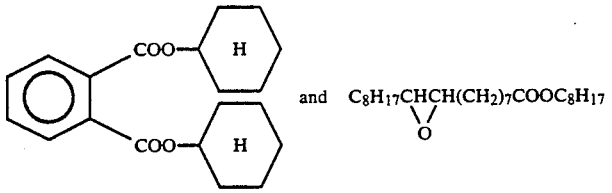

(Solv-7) Solvent:

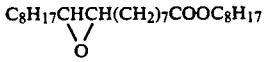

The sample thus obtained was exposed through an optical wedge for sensitometry by using a sensitometer (Fuji Photo Film Co., Ltd., FWH type, color temperature of light source: 3200° K). The exposure was adjusted to 250 CMS for an exposure time of 0.1 second.

The exposed sample was processed using the following processing stages and processing solutions.

| Processing Stage | Temperature (°C.) | Time (sec) |
|---|---|---|
| Color Development | 42 | 20 |
| Bleach-Fixing | 40 | 20 |
| Washing (1) | 40 | 7 |
| washing (2) | 40 | 7 |
| washing (3) | 40 | 7 |
| Drying | 70–80 | 15 |

A first replenisher containing a color developing agent (having the composition shown below) was placed in a container having an open ratio (surface area ($cm^2$)/volume ($cm^3$)) of 0.03, and thermostatically kept at 40° C. for 2 weeks. A fresh second replenisher containing components other than the developing agent and the above-described first replenisher are added to and mixed in the tank (processing bath) for dilution before processing to prepare a tank solution of the developer. The characteristics of the first replenisher were then evaluated.

| | |
|---|---|
| First Replenisher (the composition is described in Table B) | |
| Second Replenisher | |
| Triethanolamine | 9.20 g |
| Disodium Salt of N,N-bis(2-sulfoethyl)hydroxylamine | 6.20 g |
| Fluorescent Brightener (UVITEX CK, (Ciba Geigy) | 0.50 g |
| 1-Hydroxyethylidene-1,1-diphosphonic Acid | 0.46 g |
| Diethylenetriaminepentaacetic Acid | 2.40 g |
| N,N,N-trismethylenephosphonic Acid | 7.60 g |
| Potassium Carbonate | 31.20 g |
| Water to make | 200 ml |
| pH (25° C.) | 13.4 |
| Color Developing Solution (Tank Solution) | |
| First Replenisher | indicated in Table B |
| Second Replenisher | 200 ml |
| Potassium Chloride | 10 g |

-continued

| | |
|---|---|
| Potassium Bromide | 0.03 g |
| Water to make | 1000 ml |
| pH (25° C.) | 10.35 |
| Bleach-Fixing Solution (the tank solution was the same as the replenisher) | |
| Water | 500 ml |
| Ammonium Thiosulfate (70%) | 100 ml |
| Ammonium Sulfite | 40 g |
| Ethylenediaminetetraacetic Acid Fe (III) Ammonium | 77 g |
| Sodium Bromide | 10 g |
| Water to make | 1000 ml |
| pH (25° C.) | 6.0 |
| Rinsing Solution (the tank solution is the same as the replenisher) | |
| Municipal water | |

The washing was carried out by a three-stage countercurrent system in which the overflow solution from the final third tank was introduced into the first tank.

The densities of yellow, magenta and cyan images thus obtained were measured with a densitometer to obtain a characteristic curve.

The results are shown in Table B.

TABLE B

| No. | 4-Amino-3-methyl-N-ethyl-N-[β-methanesulfonamido) ethyl]aniline 3/2 Sulfate Monohydrate (mol/l) | | pH | Amount of First Replenisher (ml) | Relative Sensitivity* B | G | R |
|---|---|---|---|---|---|---|---|
| 1 | 0.03 | | 3.5 | 667 | 52 | 66 | 75 |
| 2 | 0.04 | | 3.5 | 500 | 65 | 78 | 87 |
| 3 | 0.05 | | 3.5 | 400 | 91 | 94 | 95 |
| 4 | 0.10 | | 3.5 | 200 | 97 | 97 | 98 |
| 5 | 0.20 | | 3.5 | 100 | 100 | 100 | 100 |
| 6 | 0.40 | | 3.5 | 50 | 100 | 100 | 100 |
| 7 | 0.20 | (Comparison) | 1.5 | 100 | 50 | 64 | 70 |
| 8 | 0.20 | | 2.0 | 100 | 82 | 89 | 93 |
| 9 | 0.20 | | 3.0 | 100 | 98 | 100 | 100 |
| 10 | 0.20 | | 5.0 | 100 | 99 | 100 | 100 |
| 11 | 0.20 | | 6.0 | 100 | 90 | 92 | 94 |
| 12 | 0.20 | (Comparison) | 7.0 | 100 | 70 | 81 | 88 |

(*The relative sensitivity is indicated relative to the sensitivity (taken as 100) obtained by the standard processing with the solution of No. 6.)

The results of Table B clearly show that the amount of the color developing agent contained in the low pH replenisher is preferably 0.05 mol/l or more, and that the pH of the low pH replenisher is preferably 2.0 to 6.0, and more preferably 3.0 to 5.0.

EXAMPLE 2

The sample obtained in the same manner as in Example 1 was likewise exposed through the optical wedge for sensitometry using the same sensitometer (Fuji Photo Film Co., Ltd., FWH type, color temperature of light source: 3200° K). The exposure was adjusted to 250 CMS for an exposure time of 0.1 second.

The exposed sample was continuously processed using the following processing stages and processing solutions until the developing solution was replenished in an amount equal to the tank capacity.

| Processing Stage | Temperature (°C.) | Time (sec) | Replenishment Rate* (ml) | Tank Capacity (l) |
|---|---|---|---|---|
| Color Development | 42 | 20 | described below | 4 |
| Bleach-Fixing | 40 | 20 | 60 | 4 |

-continued

| Processing Stage | Temperature (°C.) | Time (sec) | Replenishment Rate* (ml) | Tank Capacity (l) |
|---|---|---|---|---|
| Washing (1) | 40 | 7 | — | 2 |
| washing (2) | 40 | 7 | — | 2 |
| washing (3) | 40 | 7 | 60 | 2 |
| Drying | 70–80 | 15 | | |

*Replenishment rate: ml/m² of photographic material processed.

The replenishers were supplied in a single measured amount each time 1 m² of the photographic material was processed. The following replenishers were separately added at different time intervals so as not to be mixed with one another in high concentration.

First Replenisher (the composition is described in Table C)

The replenishment rate was 13.5 ml/m².

Second Replenisher—the same as the second replenisher of Example 1

The replenishment rate was 20.0 ml/m².

| Color Developing Solution (Tank Solution) | |
|---|---|
| First Replenisher | 100 ml |
| Second Replenisher | 200 ml |
| Potassium Chloride | 10 g |
| Potassium Bromide | 0.03 g |
| Water to make | 1000 ml |
| pH (25° C.) | 10.35 |

The same bleach-fixing and washing solutions as in Example 1 were used.

The densities of the yellow, magenta and cyan colors thus obtained were measured with a densitometer to obtain a characteristic curve.

The variation in sensitivity was calculated from the characteristic curves before and after the running test. The results are shown in Table C.

TABLE C

| No. | 4-Amino-3-methyl-N-ethyl-N-[β-methanesulfonamido) ethyl]aniline 3/2 Sulfate 1 Hydrate (mol/l) | Sodium Sulfite (mol/l) | pH | Sensitivity (Δlog E = After Running − Before Running) B | G | R |
|---|---|---|---|---|---|---|
| 13 | 0.20 | — | 3.5 | −0.00 | 0.00 | 0.00 |
| 14 | 0.20 | 0.01 (0.05) | 3.5 | 0.00 | 0.00 | 0.00 |
| 15 | 0.20 | 0.02 (0.10) | 3.5 | −0.02 | −0.01 | 0.00 |
| 16 | 0.20 | 0.04 (0.2) | 3.5 | −0.06 | −0.04 | −0.02 |
| 17 | 0.20 | 0.08 (0.40) | 3.5 | −0.08 | −0.05 | −0.03 |

The values in parentheses indicate mol ratios based on the developing agent.

By separately adding the replenishers at different time intervals good replenishment could be attained without forming any precipitates and the images having an excellent quality could be obtained. Also, when sodium sulfite which scavenges the oxidation product of the developing agent, is present in the first replenisher the first replenisher can be stored stable.

The results shown in Table C demonstrate that there is substantially no variation in sensitivity before and after running when sodium sulfite is added in an amount not more than 0.10 mol based on the content of the developing agent, and that the sensitivity is reduced after running when sodium sulfite is added in a larger amount.

EXAMPLE 3

The sample obtained in the same manner as in Example 1 was exposed through a negative film subjected to picture taking and processing, and then continuously processed using the following processing stages and processing solutions until the replenishment rate of the processing solutions reached twice the tank capacity of the color development bath. The photographic material was processed at the rate of 4 minutes per $m^2$ thereof.

| Processing Stage | Temperature (°C.) | Time (sec) | Replenishment Rate* (ml) | Tank Capacity (l) |
|---|---|---|---|---|
| Color Development | 42 | 20 | described below | 2 |
| Bleaching-Fixing | 40 | 20 | 15 | 2 |
| Washing (1) | 40 | 7 | — | 1 |
| washing (2) | 40 | 7 | — | 1 |
| washing (3) | 40 | 7 | 15 | 1 |
| Drying | 70–80 | 15 | | |

*Replenishment rate: ml per $m^2$ of light-sensitive material processed (Three tank countercurrent system from rinsing (3) to rinsing (1) was employed.)

The composition of each processing solution was as follows.

| Color Developing Solution | |
|---|---|
| First Replenisher | |
| 4-Amino-3-methyl-N-ethyl-N-[β-(methanesulfonamido)ethyl]-aniline 3/2 Sulfate 1 Hydrate | 9.50 g |
| Sodium Sulfite | 0.12 g |
| Sodium p-Toluenesulfinate | 0.88 g |
| Water to make | 100 ml |
| pH (25°C.) | 3.5 |
| Second Replenisher-the same as the second replenisher of Example 1 | |

| Tank Solution | |
|---|---|
| First Replenisher | 100 ml |
| Second Replenisher | 200 ml |
| Potassium Chloride | 10 g |
| Potassium Bromide | 0.03 g |
| Water to make | 1000 ml |
| pH (25°C.) | 10.35 |

A developing tank 300 mm wide, 120 mm high and 80 mm deep was used.

The tank solution was replenished with the following amounts of the replenishers. The two replenishers were simultaneously added to the developing bath.

| | |
|---|---|
| First Replenisher | 2.5 ml/min |
| Second Replenisher | 5.0 ml/min |

In replenishing, conduits for transferring the two replenishers to the tank solution were arranged in proximity to one another. The outlet of the second conduit for transferring the second replenisher was placed at the level of the tank solution (top surface of the tank solution), and the outlet of the first conduit for transferring the first replenisher was located as shown in each of No. 16 to No. 20 in Table D below.

The same bleach-fixing and washing solutions as in Example 1 were used.

When the running test was ended, the solution in the developing tank was removed and was inspected for the presence or absence of a precipitate. The results are shown in Table D.

TABLE D

| No. | Position of First Replenisher Conduit in Tank Solution | Condition of Tank Solution after Running |
|---|---|---|
| 16 (Comparison) | At the surface level of tank solution | x |
| 17 | One quarter the depth of the tank below the surface level | Δ |
| 18 | One half the depth of the tank below the surface level | ○ |
| 19 | Three quarters the depth of the tank below the surface level | ○ |
| 20 | The bottom of the tank | ◎ |

◎: Neither precipitate nor turbidity was observed.
○: Slight turbidity was observed.
Δ: A precipitate was slightly formed.
x: A large amount of precipitate was remarkably formed.

The results shown in Table D demonstrate that heavy precipitate formation is observed after running when the replenishers are simultaneously added at the level of the processing solution and in proximity to one another (No. 16), and that the degree of precipitation is reduced as the first replenisher is added further apart from the second replenisher (No. 17–No. 20). Also, the quality of the resulting image was excellent.

EXAMPLE 4

The sample of Example 1 was processed in the same manner as in Example 3, except that the tank solution was replenished with the replenishers using the following method.

Replenishing Method

The outlets of the conduits for transferring the two replenishers were located at the same level above the surface level of the tank solution in proximity to one another. After the beginning of running, 5.0 ml of the second replenisher was first added for 1 minute and the flow was shut off, and then 2.5 ml of the first replenisher was added for 1 minute and the flow wa shut off. These operations were alternately repeated.

As shown in Example 3, when the two replenishers were simultaneously added and replenishment was continued, heavy precipitate formation was observed. However, when the replenishers were alternately added as described above, no precipitate formation was observed after the running test.

As to the order of addition of the two replenishers, variation in photographic sensitivity was decreased during running by first adding the second replenisher, and then adding the first replenisher in alternate fashion.

EXAMPLE 5

Photographic material was prepared in the same manner as in example 1 and cut to prepare photographic material samples. Each sample was subjected to radiation exposure through a separation filter wedge for sensitometry by using a sensitometer (Fuji Photo Film Co., Ltd., FW type, color temperature of light source: 3200° K).

The exposed samples each was processed by the following processing stages and processing solutions.

| Processing Stage | Temperature (°C.) | Time (sec) | Replenishment Rate* (ml) | Tank Capacity (l) |
|---|---|---|---|---|
| Color Development | 42 | 20 | described below | 2 |
| Bleach-Fixing | 40 | 15 | 60 | 2 |
| Rinsing (1) | 40 | 5 | — | 1 |
| Rinsing (2) | 40 | 5 | — | 1 |
| Rinsing (3) | 40 | 5 | — | 1 |
| Rinsing (4) | 40 | 5 | — | 1 |
| Rinsing (5) | 40 | 10 | 60 | 1 |
| Drying | 60-80 | 15 | | |

*Replenishment rate: ml/m$^2$ of photographic material (The rinsing was carried out by a five-tank countercurrent system from rinsing (5) to rinsing (1).)

The water for rinsing (5) passed through a reverse osmosis membrane, the passing water was supplied to rinsing (5) and the concentrated water which bypassed the reverse osmotic membrane was returned to rinsing (4).

The composition of each processing solution was as follows.

| Color Developing Solution | |
|---|---|
| First Replenisher | |
| 4-Amino-3-methyl-N-ethyl-N-[β-(methanesulfonamido)ethyl]-aniline 3/2 Sulfate 1 Hydrate | 9.5 g |
| Sulfinate (described in Table E) | 0.003 mol |
| Sodium Sulfite | 0.06 g |
| Sodium 1,2-Dihydroxybenzene-4,6-disulfonate | 0.5 g |
| Water to make | 100 ml |
| pH (25° C.) | 3.5 |
| Second Replenisher | |
| Triethanolamine | 8.0 g |
| Disodium Salt of N,N-bis(2-sulfoethyl)-hydroxylamine | 4.6 g |
| Sodium Isopropylnaphthalene (β) sulfonate | 0.1 g |
| Ethylenediaminetetraacetic Acid | 2.0 g |
| Fluorescent Brightener (UNITEX CK, Ciba Geigy) | 0.5 g |
| Potassium Carbonate | 16.0 g |
| Water to make | 200 ml |
| pH (25° C.) | 13.4 |

| Color Developing Solution (Tank Solution) | |
|---|---|
| First Replenisher | 100 ml |
| Second Replenisher | 200 ml |
| Potassium Carbonate | 15 g |
| Potassium Chloride | 10 g |
| Potassium Bromide | 0.03 g |
| Water to make | 1000 ml |
| pH (25° C.) | 10.35 |

| Bleach-Fixing Solution | Tank Solution |
|---|---|
| Water | 500 ml |
| Ammonium Thiosulfate (70%) | 100 ml |
| Ammonium Sulfite | 40 g |
| Ethylenediaminetetraacetic Acid Fe (III) Ammonium | 77 g |
| Disodium Ethylenediaminetetraacetate | 5 g |
| Ammonium Chloride | 40 g |
| Acetic Acid (50%) | 25 ml |
| Water to make | 1000 ml |
| pH (25° C.) (adjusted by use of acetic acid or aqueous ammonia) | 5.8 |

(The replenisher has the same composition as that of the tank solution except that the pH of the tank solution was made 5.0)

Rinsing Solution

Ion-exchanged water (the content of each of calcium and magnesium is 3 ppm or less.)

The first replenishers for the color developing solution each having the composition indicated in Table E below were placed in vinyl chloride containers each having an open rate of 0.02 and allowed to stand in a thermostat at 40° C. for four weeks. The photographic material samples prepared above were subjected to continuous processing (running processing) by repeating alternate addition of the first replenisher and the second replenisher in the same manner as in Example 3 until the developing solution was replenished with the replenishers by a tank capacity. The replenishment rate per m$^2$ of the photographic material was 12.4 ml for the first replenisher and 20.0 ml for the second replenisher and the replenishment was conducted in the same manner as for No. 20 in Table D of Example 3.

The density of yellow, magenta and cyan colors thus developed was measured with a densitomer to obtain a so-called characteristic curve, from which the minimum density (Dmin) and the sensitivity were determined. The sensitivity was expressed as a relative value by taking as 100 the sensitivity obtained by a fresh solution before the running processing. (relative sensitivity: ΔS).

The condition of the solution in the tank was visually inspected. The results are shown in Table E below.

The results of Table E indicate that by using a replenisher containing a color developing agent and replenishing with two kinds of replenishers in accordance with the present invention it has become possible to carry out a low replenishment processing and to inhibit the occurrence of turbidity in the developing solution during a running processing with a low pH replenisher which contains a developing agent and which has been stored for a long time. Also, a low replenishment processing has become possible which provides a reduced Dmin and a small photographic variation.

Furthermore, tar formation is inhibited.

Also, by incorporating a sulfinic acid or a salt thereof which has an increased solubility in water, into a low pH replenisher it has become possible to further inhibit the occurrence of turbidity of a developing solution containing a long-stored replenisher and to provide photographic properties which are stable and free from variation in sensitivity.

TABLE E

| First Replenisher No. | Sulfinic Acid or Salt thereof | Dmin B | Dmin G | Dmin R | Relative Sensitivity | | | Turbidity of Solution |
|---|---|---|---|---|---|---|---|---|
| 21 | None | 0.14 | 0.15 | 0.22 | 70 | 78 | 85 | ○ |
| 22 | S-1 | 0.11 | 0.10 | 0.14 | 94 | 97 | 100 | ○-◎ |
| 23 | S-3 | 0.11 | 0.10 | 0.14 | 95 | 97 | 100 | ○-◎ |
| 24 | S-5 | 0.10 | 0.10 | 0.14 | 95 | 97 | 100 | ○-◎ |
| 25 | S-36 | 0.11 | 0.10 | 0.15 | 100 | 100 | 100 | ◎ |
| 26 | S-38 | 0.11 | 0.10 | 0.14 | 100 | 100 | 100 | ◎ |
| 27 | S-39 | 0.11 | 0.10 | 0.14 | 100 | 100 | 100 | ◎ |
| 28 | S-43 | 0.11 | 0.10 | 0.14 | 100 | 100 | 100 | ◎ |
| 29 | S-45 | 0.11 | 0.10 | 0.14 | 100 | 100 | 100 | ◎ |

*○A slight turbidity was observed.
◎No turbidity was observed.

In accordance with the present invention, the developing replenisher is divided into a low pH replenisher containing a developing agent and a high pH replenisher containing replenishing components other than the developing agent. The replenishers are added to the developing tank in such manner that they are not locally mixed with one another to prevent the formation of a precipitate. Consequently, a large amount of the developing agent can be dissolved in the low pH replenisher without formation of a precipitate upon replenishing the developing bath. Further, the replenisher for supplying the developing agent contains the developing agent in high concentration. Consequently, the developing function can be recovered by addition of a small amount of the replenisher. The amount of waste liquid is then greatly reduced which benefits the environment.

While the invention has been described in detail and with reference to specific embodiments thereof, it will be apparent to one skilled in the art that various changes and modifications can be made therein without departing from the spirit and scope thereof.

What is claimed is:

1. A method for processing an imagewise exposed color photographic material comprising a support having thereon at least one light-sensitive silver halide emulsion layer comprising a silver halide emulsion containing at least 90 mol % silver chloride, comprising the steps of:

(a) developing in a color developing bath;

(b) bleaching in a bath having a bleaching ability and fixing in a bath having a fixing ability or bleach-fixing in a bath having a bleaching and fixing ability; and (c) independently supplying a low pH replenisher and a high pH replenisher to the developing bath each in an amount depending on the quantity of photographic material processed, said low pH replenisher having a pH of from 2 to 6 and mainly containing a color developing agent and said high pH replenisher containing one or more components of the developing bath, wherein the components of each replenisher are sufficiently diluted upon addition to the developing bath to avoid formation of a precipitate by mixing with the components of the unlike replenisher, and wherein the low pH replenisher and the high pH replenisher are added to the color developing bath in a total amount of 60 $ml/m^2$ or less of the photographic material processed.

2. The method as in claim 1, wherein the low pH replenisher contains a p-phenylenediamine derivative as a color developing agent and a compound capable of scavenging an oxidation product of the color developing agent.

3. The method as in claim 1, wherein the low pH replenisher contains a sulfinic acid or a salt thereof and has a pH of from 2 to 6.

4. The method as in claim 3, wherein the sulfinic acid or the salt thereof is a compound in which at least one group of sulfinic acid or salt thereof is combined with an aromatic ring or a heterocyclic ring, said aromatic ring or said heterocyclic ring having at least one substituent containing a group of a carboxylic acid or a salt thereof or a group of a sulfonic acid or a salt thereof.

5. The method as in claim 1, wherein the low pH replenisher contains a color developing agent in an amount of from 0.05 to 0.6 mol/l.

6. The method as in claim 1, wherein the low pH replenisher and the high pH replenisher are added to the developing bath through separate pipes.

7. The method as in claim 1, wherein separate pipes are used to simultaneously supply each of the low pH replenisher and the high pH replenisher to the developing bath, and the points of addition to the developing bath of the supply pipes are positioned sufficiently apart from one another to avoid the formation of a precipitate.

8. The method as in claim 1, wherein a single pipe is used to supply each of the low pH replenisher and the high pH replenisher to the developing bath at staggered time intervals.

9. The method as in claim 1, wherein one of said low pH replenisher and high pH replenisher are supplied to the developing bath and diluted at least two fold in concentration before adding the other replenisher.

10. The method as in claim 1, wherein the high pH replenisher contains a pH buffer and an alkaline agent.

11. The method as in claim 1, wherein the high pH replenisher has a pH of at least 9.

12. The method as in claim 1, wherein the silver halide emulsion contains at least 98 mol % silver chloride.

13. The method as in claim 1, wherein the color developing bath is substantially free from sulfite ion.

14. The method as in claim 1, wherein the developing bath is substantially free from unsubstituted hydroxylamine.

15. A method as in claim 1, wherein the developing bath contains a substituted hydroxylamine represented by formula (I):

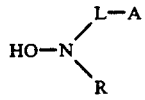

(I)

wherein L represents an alkylene group which may be substituted; A represents a carboxyl group, a sulfo group, a phosphono group, a phosphine group, a hydroxyl group, an amino group which may have an alkyl substituent group, an ammonio group which may have an alkyl substituent group, a carbamoyl group which may have an alkyl substituent group, a sulfamoyl group which may have an alkyl substituent group or an alkylsulfonyl group which may be substituted; and R represents a hydrogen atom or an alkyl group which may be substituted.

16. The method as in claim 1, wherein the developing bath contains a sulfinic acid in an amount of from 0.001 to 1.0 mol/l.

17. The method as in claim 1, wherein the developing bath contains chloride ion in an amount of $3.5\times10^{-3}$ to $1.5\times10^{-1}$ mol/l and bromide ion in an amount of from $0.5\times10^{-5}$ to $1.0\times10^{-3}$ mol/l.

* * * * *